US012680736B2

(12) United States Patent
Park et al.

(10) Patent No.: US 12,680,736 B2
(45) Date of Patent: Jul. 14, 2026

(54) COOLING APPARATUS HAVING INCREASED COOLING EFFICIENCY

(71) Applicants: Sung-Chul Park, Cheonan-si (KR); Nam-Gyu Park, Pyeongtaek-si (KR)

(72) Inventors: Sung-Chul Park, Cheonan-si (KR); Nam-Gyu Park, Pyeongtaek-si (KR)

( * ) Notice: Subject to any disclaimer, the term of this patent is extended or adjusted under 35 U.S.C. 154(b) by 539 days.

(21) Appl. No.: 18/198,973

(22) Filed: May 18, 2023

(65) Prior Publication Data

US 2023/0324089 A1 Oct. 12, 2023

Related U.S. Application Data

(63) Continuation of application No. PCT/KR2021/017232, filed on Nov. 23, 2021.

(30) Foreign Application Priority Data

Nov. 24, 2020 (KR) ..... 10-2020-0159137
May 12, 2021 (KR) ..... 10-2021-0061397
Oct. 18, 2021 (KR) ..... 10-2021-0138341

(51) Int. Cl.
*F25B 21/02* (2006.01)
*F25D 31/00* (2006.01)

(52) U.S. Cl.
CPC ..... *F25B 21/02* (2013.01); *F25D 31/003* (2013.01); *F25B 2321/023* (2013.01); *F25B 2321/0251* (2013.01)

(58) Field of Classification Search
None
See application file for complete search history.

(56) References Cited

U.S. PATENT DOCUMENTS 3,176,472 A * 4/1965 Cox ..... F25B 21/02 83/915.5
4,320,626 A * 3/1982 Donnelly ..... F25B 21/02 62/394
5,544,489 A * 8/1996 Moren ..... F25B 21/02 62/183
5,619,856 A * 4/1997 Lee ..... F25D 19/006 222/146.6
5,860,280 A * 1/1999 Recine, Sr. ..... B67D 3/0009 62/400
6,119,462 A * 9/2000 Busick ..... B67D 1/0869 62/3.3

(Continued)

FOREIGN PATENT DOCUMENTS

EP 0777090 A2 * 6/1997 ..... F25B 21/02
KR 200288737 Y1 * 9/2002 ..... F25D 19/006

(Continued)

*Primary Examiner* — Jenna M Maroney
(74) *Attorney, Agent, or Firm* — Park & Associates IP Law Office

(57) ABSTRACT

A cooling apparatus, having increased cooling efficiency, which has a cooling rod passing through the inside of a storage receptacle such that an object to be cooled stored inside the storage receptacle is cooled by means of the cooling rod, and in which the cooling rod or the storage receptacle is filled with an auxiliary cooling solution for increasing the cooling efficiency, thereby cooling the inside of the storage receptacle to a predetermined temperature even in an environment with a high external temperature.

3 Claims, 17 Drawing Sheets

(56) References Cited

U.S. PATENT DOCUMENTS

| | | | | | |
|---|---|---|---|---|---|
| 6,131,393 | A * | 10/2000 | Greene | B67D 3/0029 | 62/3.64 |
| 2004/0134932 | A1 * | 7/2004 | Lobdell | B67D 3/0029 | 222/189.06 |
| 2006/0054305 | A1 * | 3/2006 | Ye | A47J 41/005 | 165/63 |
| 2007/0056296 | A1 * | 3/2007 | Gagliano | F25D 31/003 | 62/3.64 |

FOREIGN PATENT DOCUMENTS

| | | | | | |
|---|---|---|---|---|---|
| KR | 200311024 | Y1 * | 4/2003 | A23B 9/10 | |
| KR | 100730303 | B1 * | 6/2007 | A47G 9/1009 | |
| KR | 100830687 | B1 * | 5/2008 | F25D 31/005 | |
| KR | 100830688 | B1 * | 5/2008 | F25D 31/005 | |
| KR | 20110062725 | A * | 6/2011 | A23B 9/10 | |
| KR | 101142827 | B1 * | 5/2012 | | |
| KR | 20120046437 | A * | 5/2012 | A23B 2/80 | |
| KR | 20210104407 | A * | 8/2021 | A47J 47/01 | |
| KR | 20240003581 | A * | 1/2024 | C09K 5/06 | |
| KR | 20240028014 | A * | 3/2024 | F25D 16/00 | |
| KR | 102789723 | B1 * | 4/2025 | F25B 21/02 | |
| WO | WO-9707369 | A1 * | 2/1997 | F25B 21/02 | |
| WO | WO-2013089306 | A1 * | 6/2013 | A23B 9/10 | |

* cited by examiner

COOLING APPARATUS HAVING INCREASED COOLING EFFICIENCY

REFERENCE TO RELATED APPLICATIONS

This is a continuation of International Patent Application PCT/KR2021/017232 filed on Nov. 23, 2021, which designates the United States and claims priority of Korean Patent Application No. 10-2020-0159137 filed on Nov. 24, 2020, and Korean Patent Application No. 10-2021-0061397 filed on May 12, 2021, and Korean Patent Application No. 10-2021-0138341 filed on Oct. 18, 2021, the entire contents of which are incorporated herein by reference.

FIELD OF THE INVENTION

The present invention relates to a cooling apparatus, having increased cooling efficiency, which has a cooling rod installed passing through the inside of a storage receptacle such that an object to be cooled stored inside the storage receptacle is cooled by means of the cooling rod, and in which the cooling rod or the storage receptacle is filled with an auxiliary cooling solution for increasing the cooling efficiency, thereby cooling the inside of the storage receptacle to a preset temperature even in an environment with a high external temperature.

BACKGROUND OF THE INVENTION

In general, thermoelectric elements are mainly used as cooling means for small home appliances such as small refrigerators, small water purifiers, and cold water mats.

Such a thermoelectric element is a semiconductor device, in which heat is radiated (heated) at a junction in a forward direction and heat is absorbed (cooled) at a junction in the opposite direction when a current is applied, and can be implemented in a low-power and ultra-small size.

Korean Registered Utility Model No. 20-0390039 (title of invention: cooling apparatus of grain refrigerator) (hereinafter, referred to as "prior art") discloses a grain refrigerator to which such a thermoelectric element is applied.

FIG. 1 is a perspective view of the prior art.

The prior art 900 includes a cooling post 910, a housing 920, a heater wire 930, heat radiation fins 940, and a cooling fan 950, as shown in FIG. 1.

The cooling post 910 is formed in a cylindrical shape and is made of a material having excellent thermal conductivity.

In addition, a Peltier element 911 is attached to a lower surface of the cooling post 910.

When a current is applied to the Peltier element 911, one surface of the Peltier element 911 is cooled and the other surface is heated.

The surface of the Peltier element 911, which is cooled, is attached to the cooling post 910 so as to transfer cold air to the cooling post 910, and the other surface of the Peltier element 911, which is heated, is attached to the heat radiation fins 940 so as to release heat to the outside.

The housing 920 is installed to surround the cooling post 910 and transfers the cool air emitted from the cooling post 910 to grains.

In addition, the housing 920 has air permeability and is formed of a material such as ocher or charcoal capable of absorbing moisture, thereby absorbing moisture that may be generated during a cooling process so as to prevent the grains from being exposed to moisture.

The heater wire 930 is installed in a space between the cooling post 910 and the housing 920. When it is detected that humidity inside the housing 920 exceeds a threshold value by a humidity sensor (not shown) installed inside the housing 920, it is determined that moisture is formed on an outer surface of the cooling post 910 due to condensation, so that the moisture formed on the outer surface of the cooling post 910 is removed by heat.

The heat radiation fins 940 respectively have one surface coming into contact with the Peltier element 911 and radiate heat transmitted through the Peltier element 911 to the outside.

The cooling fan 950 is provided to the heat radiation fins 940 so as to discharge heat from the heat radiation fins 940 to the outside.

The grain refrigerator, to which the prior art 900 configured as described above is applied, can prevent grains from rotting or being damaged by cooling the grains therein through the cooling post 910 and the housing 920 and removing moisture inside the housing 920 through the heater wire 930, thereby discharging the moisture inside the housing 920 to the outside.

However, this prior art 900 has problems in that since there is no separate means for increasing the cooling efficiency of the cooling post 910, when the cooling post 910 is cooled with one Peltier element 911, the time taken to cool the cooling post 910 to a target temperature may be increased. Moreover, if the outside temperature is high, cooling to a target temperature may not be possible.

SUMMARY OF THE INVENTION

The present invention is derived to solve the problems, and an object of the present invention is to provide a cooling apparatus having increased cooling efficiency, in which a cooling rod is installed to the inside of a storage receptacle through the storage receptacle where an object to be cooled is stored and the cooling rod installed inside the storage receptacle is cooled by a thermoelectric element so that the object stored inside the storage receptacle can be cooled.

In addition, another object of the present invention is to provide a cooling apparatus having increased cooling efficiency, in which a carbon allotrope with high thermal conductivity is attached to a cooling rod, so that the cooling efficiency of the cooling rod can be increased, improving cooling speed, and the temperature of the cooling rod can be smoothly cooled to a target temperature even when the outside temperature is high.

In addition, a further object of the present invention is provide a cooling apparatus having increased cooling efficiency, in which a ring-shaped ice making part is installed to surround an outer circumferential surface of a cooling rod at a position adjacent to a thermoelectric element, so that ice is filled inside by the cold air of the thermoelectric element and the inside of the cooling rod and a storage receptacle can be quickly cooled by the ice filled inside.

In addition, still another object of the present invention is to provide a cooling apparatus having increased cooling efficiency, in which an auxiliary cooling solution with high thermal conductivity and heat capacity is filled in a cooling rod so as to increase the cooling speed of the cooling rod, and an insulation material is installed to surround a sidewall and a lower surface of a storage receptacle so as to prevent inflow of external heat, thereby cooling the inside of the storage receptacle to a temperature set by a user even in an environment with a high external temperature.

In addition, still another object of the present invention is to provide a cooling apparatus having increased cooling efficiency, in which a second heat sink formed in the shape of a square plate is installed on top of a heat radiation fin structure, and a first heat sink formed in a cross shape is installed on top of the second heat sink, with each end portion disposed outside the second heat sink, wherein the first heat sink and the second heat sink are made of materials such as copper and silver, which have thermal conductivity higher than that of aluminum used in existing heat dissipation structures, thereby increasing heat dissipation efficiency as well as the cooling efficiency of a thermoelectric element.

In addition, yet another object of the present invention is to provide a cooling apparatus having increased cooling efficiency, in which a carbon allotrope with high thermal conductivity is respectively inserted between a heat radiation fin structure and a second heat sink, and between the second heat sink and a first heat sink so as to increase thermal conductivity of an entire heat dissipation part, thereby increasing heat dissipation efficiency.

In addition, yet another object of the present invention is to provide a cooling apparatus having increased cooling efficiency, in which when a cooling rod having a structure in which a plurality of ice buckets each having an internal space are connected is cooled by a thermoelectric element, ice is made sequentially from the ice bucket installed adjacent to the thermoelectric element and the ice made inside the ice buckets cools water inside a storage receptacle so that not only the water can be cooled to a certain temperature by the ice but also a contact area with water can be increased by a cooling rod installed inside a cold water container so that water contained in the cold water container can be uniformly cooled.

In addition, yet another object of the present invention is to provide a cooling apparatus having increased cooling efficiency, in which since cooling tubes filled with an auxiliary cooling solution with large heat capacity are installed inside a cold water container, even if cooling of a thermoelectric element is stopped due to a power failure, a breakdown or the like, cold air is maintained for a long time by ice generated inside a cooling rod and an auxiliary cooling solution filled in the cooling tubes, so that the temperature of water contained in the cold water container can be kept cold for a long time.

In addition, yet another object of the present invention is to provide a cooling apparatus having increased cooling efficiency, in which a cold air transfer part, which has a thermoelectric element attached to a rear end thereof so as to receive cold air directly, is installed to surround a cooling rod, so that the cold air of the thermoelectric element is evenly distributed throughout the cooling rod, thereby increasing an ice-making speed inside ice buckets.

In addition, yet another object of the present invention is to provide a cooling apparatus having increased cooling efficiency, in which cooling tubes filled with an auxiliary cooling solution are disposed inside ice buckets, and the cooling tubes are connected to a cold air transfer part so as to receive cold air, so that even if cooling of a thermoelectric element is stopped due to a breakdown, a power failure or the like, long-term cooling is possible as the time it takes for ice made inside the ice buckets to melt is increased.

The objects of the present invention to solve the above problems are achieved by a cooling apparatus, which includes a case, a storage receptacle installed inside the case and storing water therein, and a cooling part for cooling the water stored in the storage receptacle, the cooling apparatus characterized in that the cooling part includes: a cooling rod, an upper end portion of which penetrates a bottom surface of the storage receptacle and protrudes into the storage receptacle, and a lower end portion of which is positioned lower than the bottom surface of the storage receptacle; a cooling means installed on a lower surface of the cooling rod so as to cool the cooling rod; and a tube body, which is formed in a tube shape with an upper portion closed and is installed to surround the cooling rod.

In addition, it is preferable herein that a plurality of through holes are formed penetrating the tube body from an outer circumferential surface of the tube body to an inner circumferential surface thereof.

In addition, it is preferable herein that partition walls are formed in a plate shape and respectively have at least one or more drain holes, and the partition walls are installed so as to be spaced apart from each other in the vertical direction inside the storage receptacle such that an inner space of the storage receptacle is separated by the partition walls.

In addition, it is preferable herein that the cooling rod is formed in a circular rod shape with a space formed therein, and at least one or more adhesive elements each having a carbon allotrope attached to an adhesive surface are attached to an inner circumferential surface of the cooling rod in the longitudinal direction of the cooling rod.

In addition, according to the present invention, there is provided a cooling apparatus installed in a storage receptacle so as to cool an object to be cooled stored inside the storage receptacle, the cooling apparatus including: a cooling rod, which is installed inside the storage receptacle by passing through a bottom surface of the storage receptacle, and a lower end portion of which is positioned lower than the bottom surface of the storage receptacle; a cooling means installed on a lower surface of the cooling rod; and a heat dissipation part installed on a lower surface of the cooling means and dissipating heat generated by the cooling means to the outside, wherein adhesive elements each having a carbon allotrope attached to an adhesive surface are attached to an outer circumferential surface of the cooling rod so as to be spaced apart from each other in a vertical direction of the cooling rod.

In addition, in the present invention, the carbon allotrope is graphite of which layers are separated through an exfoliation process.

In addition, it is preferable herein that auxiliary cooling solution insertion grooves are formed on an upper surface of the cooling rod such that an auxiliary cooling solution and cotton are inserted into the auxiliary cooling solution insertion grooves.

In addition, according to the present invention, there is provided a cooling apparatus including a mat part with a circulation pipe installed therein so that water circulates through the circulation pipe, and a cold water circulation part, which is connected to the circulation pipe and cools circulating water, the cooling apparatus characterized in that the cold water circulation part includes: a case; a cold water container, which is installed inside the case so as to receive water and connected to the circulation pipe; a cooling part for cooling the water received in the cold water container; and a motor for circulating the water received in the cold water container, wherein the cooling part includes: a cooling rod, which is formed in a rod shape and installed inside the cold water container; and a cooling means for cooling the cooling rod, and wherein the cooling rod is formed in a column shape with a space formed therein, and includes a plurality of ice buckets in which ice is generated during cooling.

In addition, it is preferable herein that the cold water circulation part is formed in a rod shape and installed inside the cold water container, has an outer circumferential surface that comes into contact with the cooling rod, and further includes at least one or more cooling tubes filled with an auxiliary cooling solution therein.

In addition, it is preferable herein that the auxiliary cooling solution is prepared by mixing 70 to 80 wt % of acetic acid and 20 to 30 wt % of salt.

In addition, according to the present invention, there is provided a cooling apparatus installed in a storage receptacle so as to cool an object to be cooled stored inside the storage receptacle, the cooling apparatus comprising: a cooling rod, which is installed inside the storage receptacle by passing through a bottom surface of the storage receptacle, and a lower end portion of which is positioned lower than the bottom surface of the storage receptacle; a cooling means installed on a lower surface of the cooling rod; a heat dissipation part installed on a lower surface of the cooling means and dissipating heat generated by the cooling means to the outside; and an auxiliary cooling ring, which is formed in a ring shape with a cavity formed therein so that the cooling rod passes through the cavity inside the auxiliary cooling ring, and which is installed at a position adjacent to a lower end portion of the cooling rod during installation.

In addition, it is preferable herein that the cooling means is a thermoelectric element.

According to the present invention with the problems and problem solving means as described above, the cooling rod is installed to the inside of the storage receptacle through the storage receptacle where an object to be cooled is stored and the cooling rod installed inside the storage receptacle is cooled by a thermoelectric element so that the object stored inside the storage receptacle can be cooled.

In addition, according to the present invention, a carbon allotrope with high thermal conductivity is attached to the cooling rod, so that the cooling efficiency of the cooling rod is increased, improving cooling speed, and the temperature of the cooling rod can be smoothly cooled to a target temperature even when the outside temperature is high.

In addition, according to the present invention, the ring-shaped ice making part is installed to surround the outer circumferential surface of the cooling rod at a position adjacent to the thermoelectric element, so that ice is filled inside by the cold air of the thermoelectric element and the inside of the cooling rod and the storage receptacle can be quickly cooled by the ice filled inside.

In addition, according to the present invention, the auxiliary cooling solution with high thermal conductivity and heat capacity is filled in the cooling rod so as to increase the cooling speed of the cooling rod, and the insulation material is installed to surround the sidewall and the lower surface of the storage receptacle so as to prevent inflow of external heat, thereby cooling the inside of the storage receptacle to a temperature set by a user even in an environment with a high external temperature.

In addition, according to the present invention, the second heat sink formed in the shape of a square plate is installed on top of the heat radiation fin structure, and the first heat sink formed in a cross shape is installed on top of the second heat sink, with each end portion disposed outside the second heat sink, wherein the first heat sink and the second heat sink are made of materials such as copper and silver, which have thermal conductivity higher than that of aluminum used in existing heat dissipation structures, thereby increasing heat dissipation efficiency as well as the cooling efficiency of the thermoelectric element.

In addition, according to the present invention, a carbon allotrope with high thermal conductivity is respectively inserted between the heat radiation fin structure and the second heat sink, and between the second heat sink and the first heat sink so as to increase the thermal conductivity of the entire heat dissipation part, thereby increasing the heat dissipation efficiency.

In addition, according to the present invention, when the cooling rod having the structure in which the plurality of ice buckets each having an internal space are connected is cooled by the thermoelectric element, ice is made sequentially from the ice bucket installed adjacent to the thermoelectric element and the ice made inside the ice buckets cools the water inside the storage receptacle so that not only the water can be cooled to a certain temperature by the ice but also the contact area with the water can be increased by the cooling rod installed inside the cold water container so that the water contained in the cold water container can be uniformly cooled.

In addition, according to the present invention, since the cooling tubes filled with the auxiliary cooling solution with large heat capacity are installed inside the cold water container, even if cooling of the thermoelectric element is stopped due to a power failure, a breakdown or the like, cold air is maintained for a long time by the ice generated inside the cooling rod and the auxiliary cooling solution filled in the cooling tubes, so that the temperature of the water contained in the cold water container can be kept cold for a long time.

In addition, according to the present invention, the cold air transfer part, which has the thermoelectric element attached to the rear end thereof so as to receive cold air directly, is installed to surround the cooling rod, so that the cold air of the thermoelectric element is evenly distributed throughout the cooling rod, thereby increasing the ice-making speed inside the ice buckets.

In addition, according to the present invention, the cooling tubes filled with the auxiliary cooling solution are disposed inside the ice buckets, and the cooling tubes are connected to the cold air transfer part so as to receive cold air, so that even if cooling of the thermoelectric element is stopped due to a breakdown, a power failure or the like, long-term cooling is possible as the time it takes for the ice made inside the ice buckets to melt is increased.

DETAILED DESCRIPTION OF THE INVENTION

Hereinafter, one embodiment of the present invention will be described with reference to the accompanying drawings.

Figure 1:
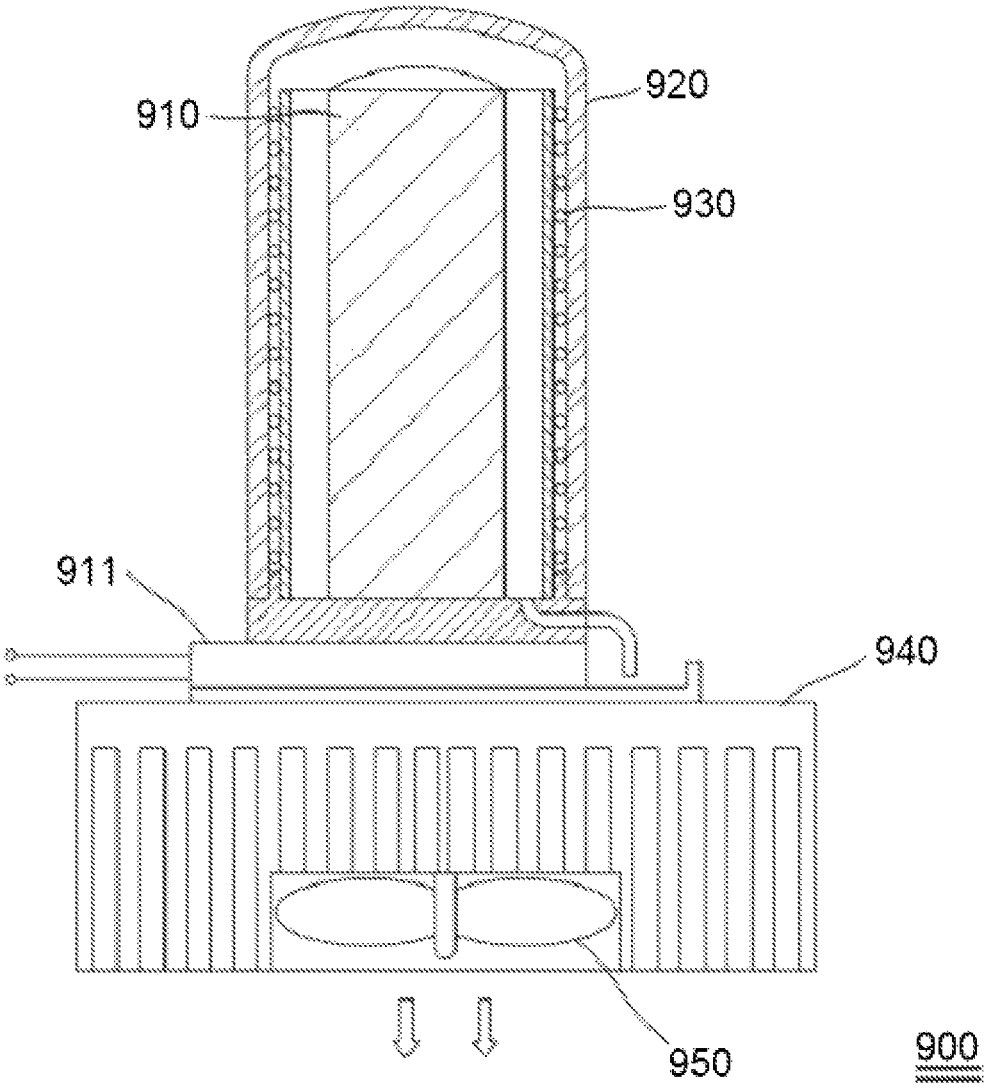
FIG. 1 is a perspective view of the prior art.
Figure 2:
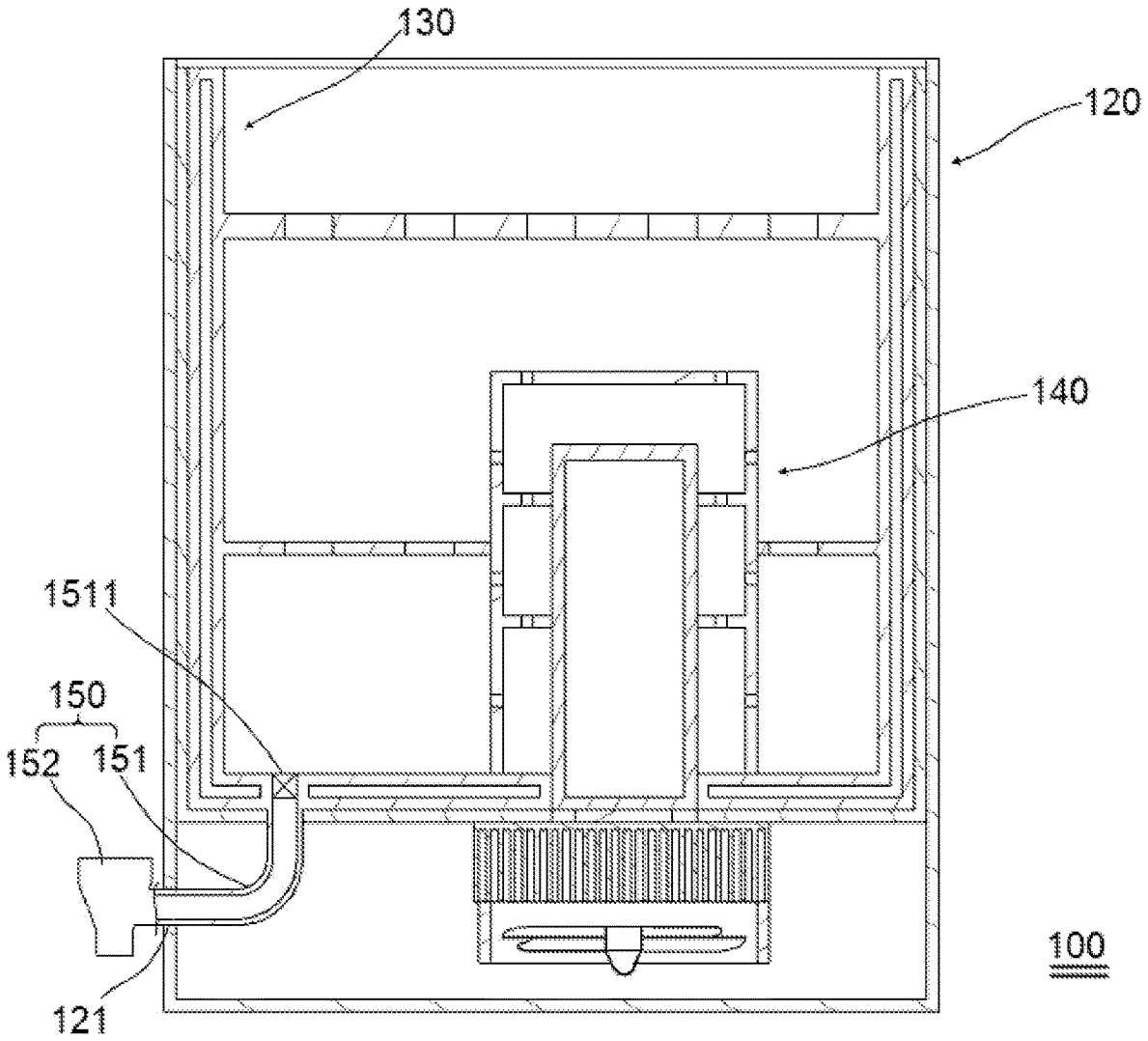
FIG. 2 is a cross-sectional view of a cooling apparatus according to the present invention.

FIG. 2 is a cross-sectional view of a cooling apparatus according to a first embodiment of the present invention.

A first cooling apparatus 100 includes a cooling rod installed vertically inside a storage receptacle, wherein water stored inside the storage receptacle is cooled by the cooling rod so that the water stored inside the storage receptacle can be evenly cooled.

The first cooling apparatus 100 includes, as shown in FIG. 2, a case 120, a storage receptacle 130, a cooling part 140, and a drain part 150.

The case 120 is formed in the shape of an enclosure with an open top, in which the storage receptacle 130, the cooling part 140, and the drain part 150 are installed.

Herein, referring to FIG. 2, the shape of the case 120 is illustrated as a square box shape for convenience of description, but the shape of the case 120 is not limited thereto and may be formed in various shapes such as a cylinder or a polygonal column.

In addition, a drain pipe insertion hole 121 is formed in one surface of the case 120 so that a drain pipe 151, which is described hereinafter, passes therethrough.

Figure 3:
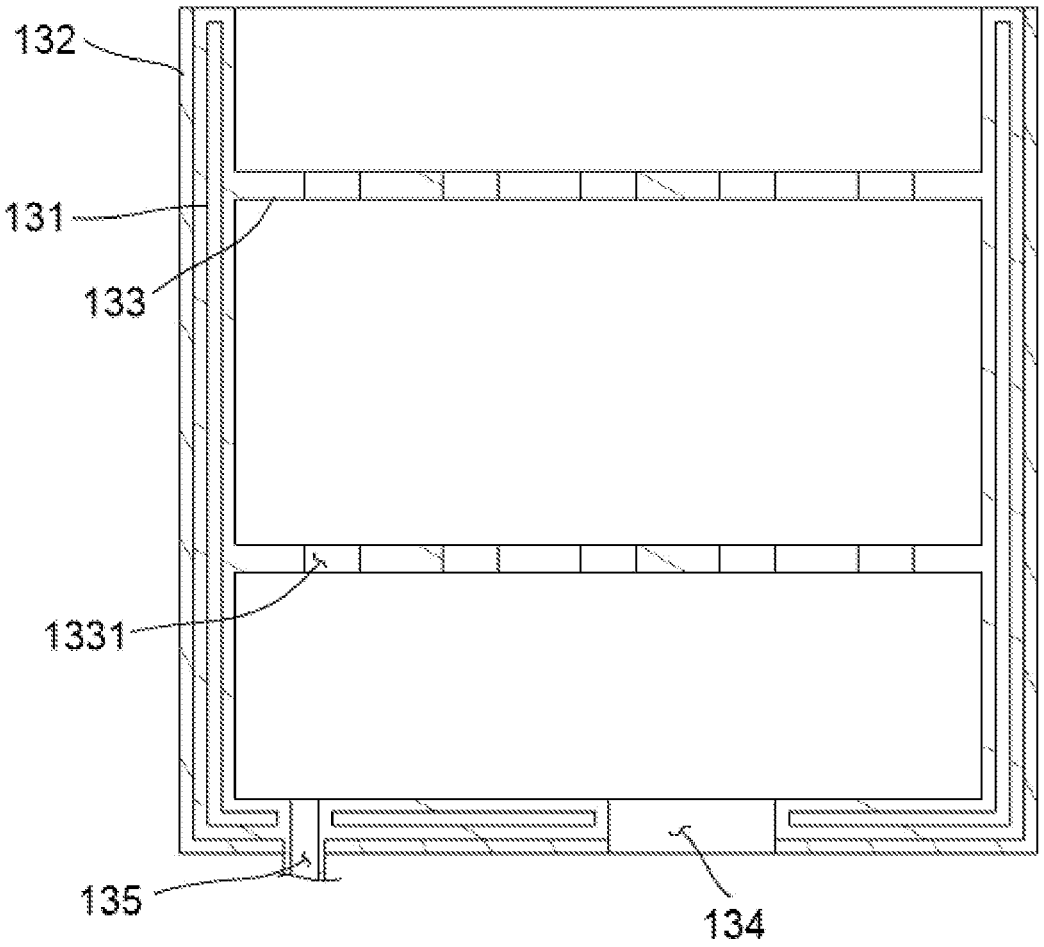
FIG. 3 is a cross-sectional perspective view of a storage receptacle shown in FIG. 2.

FIG. 3 is a cross-sectional perspective view of the storage receptacle of FIG. 2.

The storage receptacle 130 is formed in the shape of an enclosure with an open top, as shown in FIG. 3.

In addition, an auxiliary cooling solution 131 and cotton are inserted into a sidewall and a lower surface of the storage receptacle 130.

The auxiliary cooling solution 131 is a solution composed of 70 to 80 wt % of acetic acid and 20 to 30 wt % of salt, wherein the auxiliary cooling solution 131 is absorbed into the cotton and inserted into the sidewall and lower surface of the storage receptacle 130.

Since the auxiliary cooling solution 131 has high thermal conductivity and heat capacity when salt is dissolved in acetic acid, the storage container 130 into which the auxiliary cooling solution is inserted has increased high thermal conductivity and heat capacity, thereby increasing cooling efficiency.

In addition, since the auxiliary cooling solution 131 is inserted into the storage receptacle 130 in a state absorbed by the cotton, a storage period of the auxiliary cooling solution 131 is increased compared to when it is inserted in a solution form.

This auxiliary cooling solution 131 has not only high thermal conductivity but also a large heat capacity, so that the auxiliary cooling solution 131 maintains a cooling state for a long time even if the outside temperature decreases. Therefore, even when cooling of a Peltier element 1411 is stopped due to a power failure, a breakdown or the like, the auxiliary cooling solution 131 maintains the cooling state of the storage receptacle 130, thereby increasing the time required for the temperature of the water stored in the storage receptacle 130 to rise.

In addition, an insulation material 132 is installed on the outside of the sidewall and lower surface of the storage receptacle 130.

The insulation material 132 can prevent external heat from being introduced into the storage receptacle 130 and also prevent internal cool air from being discharged to the outside, thereby preventing decrease of cooling efficiency.

In addition, a plurality of partition walls 133 are installed inside the storage receptacle 130.

The partition walls 133 are formed in a plate shape and are installed spaced apart from each other in the vertical direction inside the storage receptacle 130 so as to divide the internal space of the storage receptacle 130, wherein the partition walls 133 have drain holes 1331 so as to allow water to flow.

The storage receptacle 130 is configured such that the water stored therein is partitioned by the partition walls 133 and flows through the drain holes 1331 so that the convection speed of the water decreases.

Therefore, when water at room temperature is supplied from the outside, it is possible to prevent water at a position adjacent to the drain part 150 from being mixed with the water supplied from the outside, thereby preventing increase of temperature.

That is, even if water is supplied from the outside to the storage receptacle 130, the convection speed is reduced by the partition walls 133, so that the water stored inside can be prevented from being mixed with the water supplied from the outside and a rapid rise in temperature can be prevented. In addition, it is possible to secure sufficient time for the water supplied from the outside to be cooled by the cooling part 140, thereby preventing the temperature of water discharged through the drain part 150 from rising.

Furthermore, the storage receptacle 130 is formed with a cooling rod through hole 134 to be penetrated by a cooling rod 141, which is described hereinafter, and a drain part connection hole 135 in the lower surface of the storage receptacle 130.

In the storage receptacle 130 configured as described above, the auxiliary cooling solution 131 is filled in the sidewall and lower surface of the storage receptacle 130 so as to increase cooling efficiency, so that the water stored inside the storage receptacle 130 can be quickly cooled. In addition, the external heat is prevented from entering the inside, so that the water stored inside the storage receptacle 130 can be quickly cooled. At the same time, the internal temperature of the storage receptacle 130 can be maintained at a preset temperature even when the external temperature is high.

In addition, the storage receptacle 130 reduces the convection speed of water by the partition walls 133, thereby preventing the temperature of the water discharged through the drain part 150 from rising even when water of room temperature is supplied from the outside.

Figure 4:
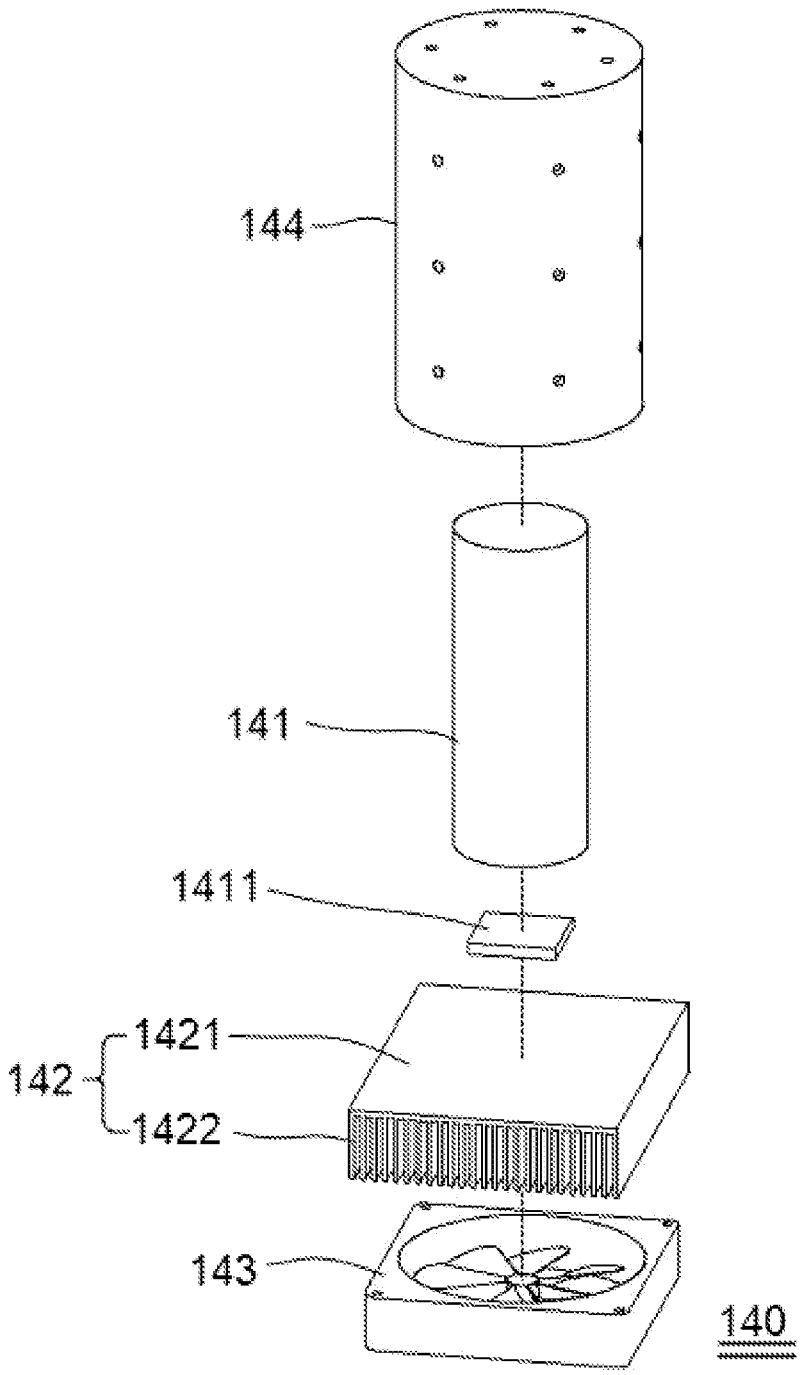
FIG. 4 is an exploded perspective view of a cooling part shown in FIG. 2.
Figure 5:
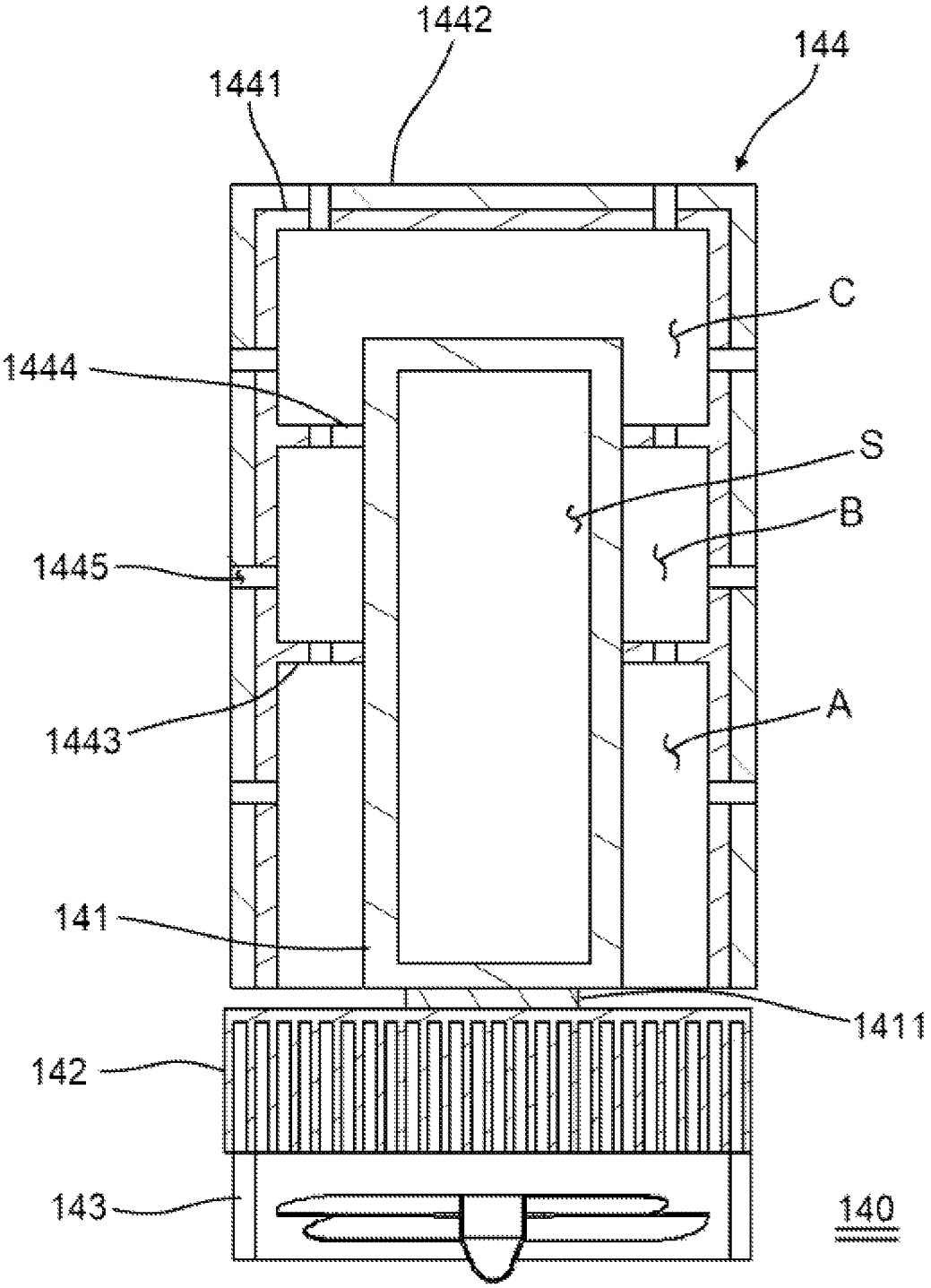
FIG. 5 is a cross-sectional view of the cooling part of FIG. 2.

FIG. 4 is an exploded perspective view of the cooling part of FIG. 2, and FIG. 5 is a cross-sectional view of the cooling part of FIG. 2.

The cooling part 140 includes the cooling rod 141, a heat sink structure 142, a cooling fan 143, and a tube body 144, as shown in FIG. 4.

The cooling rod 141 is formed in a circular rod shape, and the Peltier element 1411 is attached to a lower surface of the cooling rod.

The Peltier element 1411 is an element that operates on the principle that one side is cooled while the other side is heated when a current flows.

One side of this Peltier element 1411 is attached to the lower surface of the cooling rod 141 so as to cool the cooling rod 141, and the other side is attached to an upper surface of the heat sink structure 142 so as to heat the heat sink structure 142.

In addition, salt S is filled in the cooling rod 141.

Since the salt S has low thermal conductivity, it is quickly cooled by cold air generated by the Peltier element 1411 and also retains the cold air generated by the Peltier element 1411.

This cooling rod 141 is filled with salt S therein so as to increase cooling efficiency, so that the temperature inside the storage receptacle 3 can be cooled to a preset temperature even when the temperature of the outside (i.e., the outside of the case) is high.

The heat sink structure 142 includes a flat-plate shaped heat dissipation frame 1421 with the Peltier element 1411 attached to the upper surface thereof, and a plurality of flat-plate shaped heat sinks 1422 vertically coupled to a lower surface of the heat dissipation frame 1421.

The heat sink structure 142 receives heat generated by the Peltier element 1411 through the heat dissipation frame 1421 and releases the heat into the air through the heat sinks 1422.

The cooling fan 143 is installed below the heat sink structure 142 and cools the heat sink structure 142, so that the heat of the Peltier element 1411 can be more quickly discharged to the outside and the cooling process of the cooling rod 141 can be performed smoothly.

The tube body 144 is formed in a circular tube shape with an upper portion closed, and is composed of a double wall body with an inner wall 1441 and an outer wall 1442.

In addition, the tube body 144 includes a first partition plate 1443 and a second partition plate 1444, which are installed to be spaced apart from each other in the vertical direction inside the tube body 144.

In addition, the tube body 144 has a plurality of through holes 1445 formed in the inner wall 1441, the outer wall 1442, and the partition plates 1443, 1444, so as to allow water to flow in or out.

Herein, in the tube body 144, the inner wall 1441 is made of a material with high thermal conductivity so as to be quickly cooled by the cold air emitted from the cooling rod 141, thereby lowering its temperature, while the outer wall 1442 is made of a material with low thermal conductivity and thus has a temperature relatively higher than the inner wall 1441.

This tube body 144 is configured so that an inner space thereof is partitioned by the first partition plate 1443 and the second partition plate 1444 and water can move to each partitioned space through the through holes 1445.

Herein, for convenience of description, it is assumed that, for example, a space formed between the storage receptacle 130 and the first partition plate 1443 is area A, a space formed between the first partition plate 1443 and the second partition plate 1444 is area B, and a space formed between the second partition plate 1444 and the upper surface of the tube body 144 is area C.

Since area A is formed at a position closest to the Peltier element 1411, temperature decreases most rapidly inside the storage receptacle 130.

Accordingly, ice is formed in area A on the basis of the cooling rod 141, the inner wall 1441, and the first partition plate 1443 that are positioned inside area A, and as time elapses, the entire part of area A turns into ice.

Since area B is positioned farther from the Peltier element (1411) than area A, ice formation starts later than area A, wherein area B is positioned adjacent to area A, ice is formed therein by the cold air transmitted from area A and the cooling rod 141. Over time, the entire part of area B is filled with ice.

Since area C is positioned farther from the Peltier element 1411 than areas A and B, ice formation starts later than areas A and B, wherein ice is formed therein by the cold air transmitted from area C and the cooling rod 141. As time elapses, the entire part of area C is filled with ice.

That is, when the tube body 144 is cooled, ice is formed and filled sequentially in area A, area B, and area C, and is formed long in the vertical direction, wherein ice is prevented from forming on the outer wall 1442 and is induced to fill the inner spaces of the tube body 144.

At this time, since the water stored in the storage container 130 is cooled by the cold air of the ice formed inside the tube body 144, the cooling rate is increased and the cooling is uniformly performed in the vertical direction In addition, the storage receptacle 130 is configured such that the water stored in the storage receptacle 130 comes into direct contact with ice through the through holes 1445 formed in the tube body 144 and the cold air of the ice is directly transmitted to the water, thereby increasing the cooling rate.

The tube body 144 is filled with ice in the internal spaces (area A, area B, area C), and the ice is formed long in the vertical direction. Therefore, by cooling not only the water in the lower portion of the storage receptacle 130, which is adjacent to the Peltier element 1411, but also the water in the upper portion together, contact areas with the water stored inside the storage receptacle 130 are increased so that the water stored inside the storage receptacle 130 can be uniformly cooled.

In addition, the tube body 144 can prevent the drain part 150 from being closed by ice by fixing the shape and position of ice formed on the outer circumferential surface of the cooling rod 141.

The drain part 150 is composed of a drain pipe 151 and a cock 152.

The drain pipe 151 is installed such that one end portion thereof is connected to the storage receptacle 130 and the other end protrudes out of the case 120.

In addition, the cock 152 is installed at the other end portion of the drain pipe 151 so that a user can discharge water from the inside of the storage receptacle 130 by manipulating the cock 152.

Herein, a check valve 1511 is installed inside the drain pipe 151.

The check valve 1511 is installed at a connection part between the storage receptacle 130 and the drain pipe 151, and is configured to be opened only when the cock 152 is manipulated by the user so as to prevent water or air discharged to the outside from flowing backward.

This check valve 1511 can prevent the temperature of the water stored in the storage receptacle 130 from increasing due to air or water flowing backward through the drain pipe 151.

In the first cooling apparatus 100 configured as described above, ice is formed long in the vertical direction by the tube body 144 installed to surround the cooling rod 141, and the shape of ice is limited by the tube body 144, so that the water inside the storage receptacle 130 is uniformly cooled by the ice formed long in the vertical direction, and at the same time, the cooling speed increases.

In addition, the first cooling apparatus 100 is configured such that the plurality of partition walls 133 are installed inside the storage receptacle 130 so as to reduce the convection speed of water, so that when water is supplied from the outside, the temperature of the water stored inside can be prevented from rapidly decreasing by the supplied water. Moreover, cold air discharged from the cooling part 140 is retained inside the storage receptacle 130 by the auxiliary cooling solution 131 filled inside the sidewall and lower surface of the storage receptacle 130 as well as the insulation material 132. As a result, the cooling efficiency is increased.

This first cooling apparatus 100 is configured to cool the water stored inside the storage receptacle 130 to a temperature desired by the user, without installing a plurality of Peltier elements 1411, even in an environment of a high external temperature, thereby reducing manufacturing costs and maintenance costs.

Figure 6:
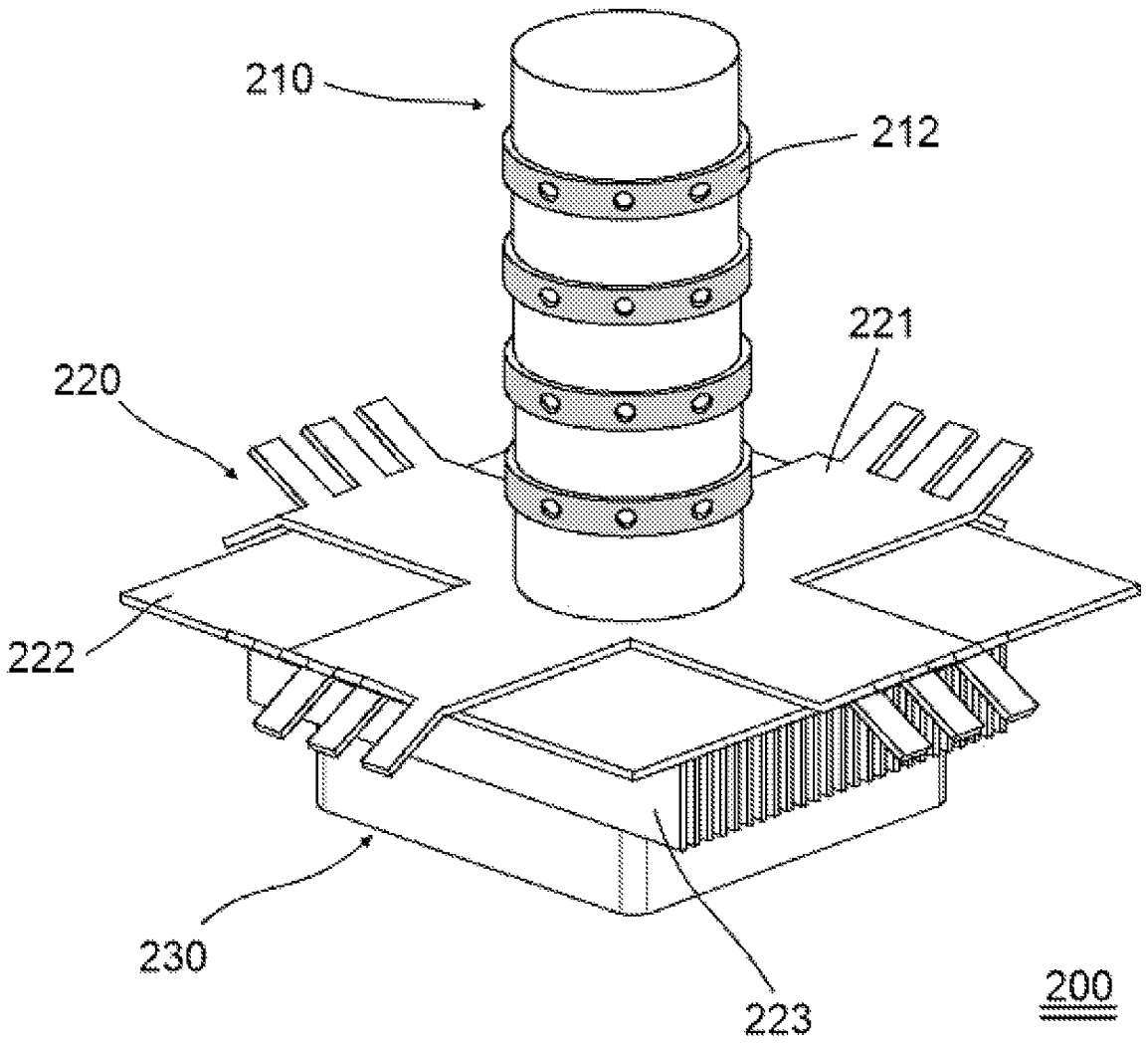
FIG. 6 is a perspective view of a second cooling apparatus according to a second embodiment of the present invention.
Figure 7:
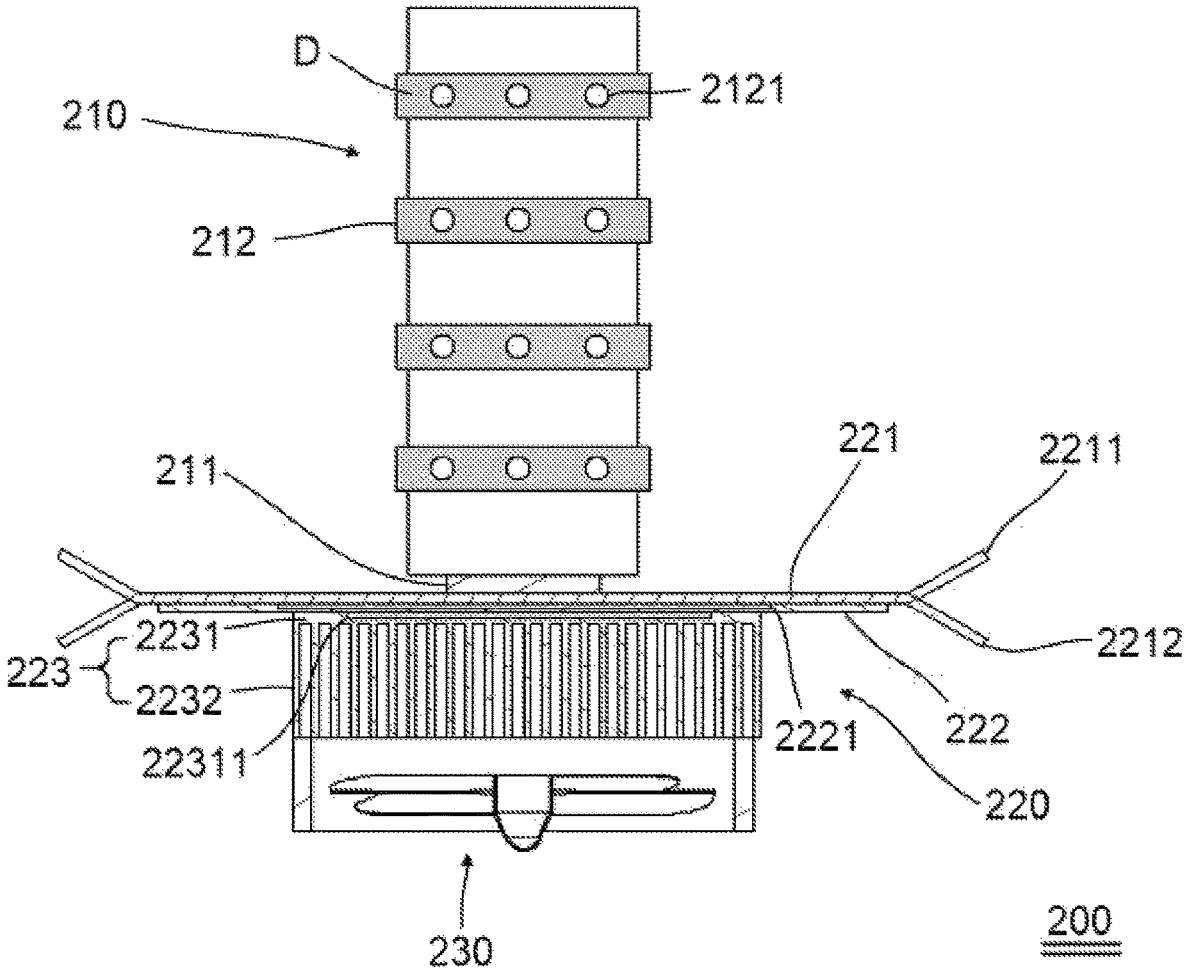
FIG. 7 is an exemplary cross-sectional view of FIG. 6.
Figure 8:
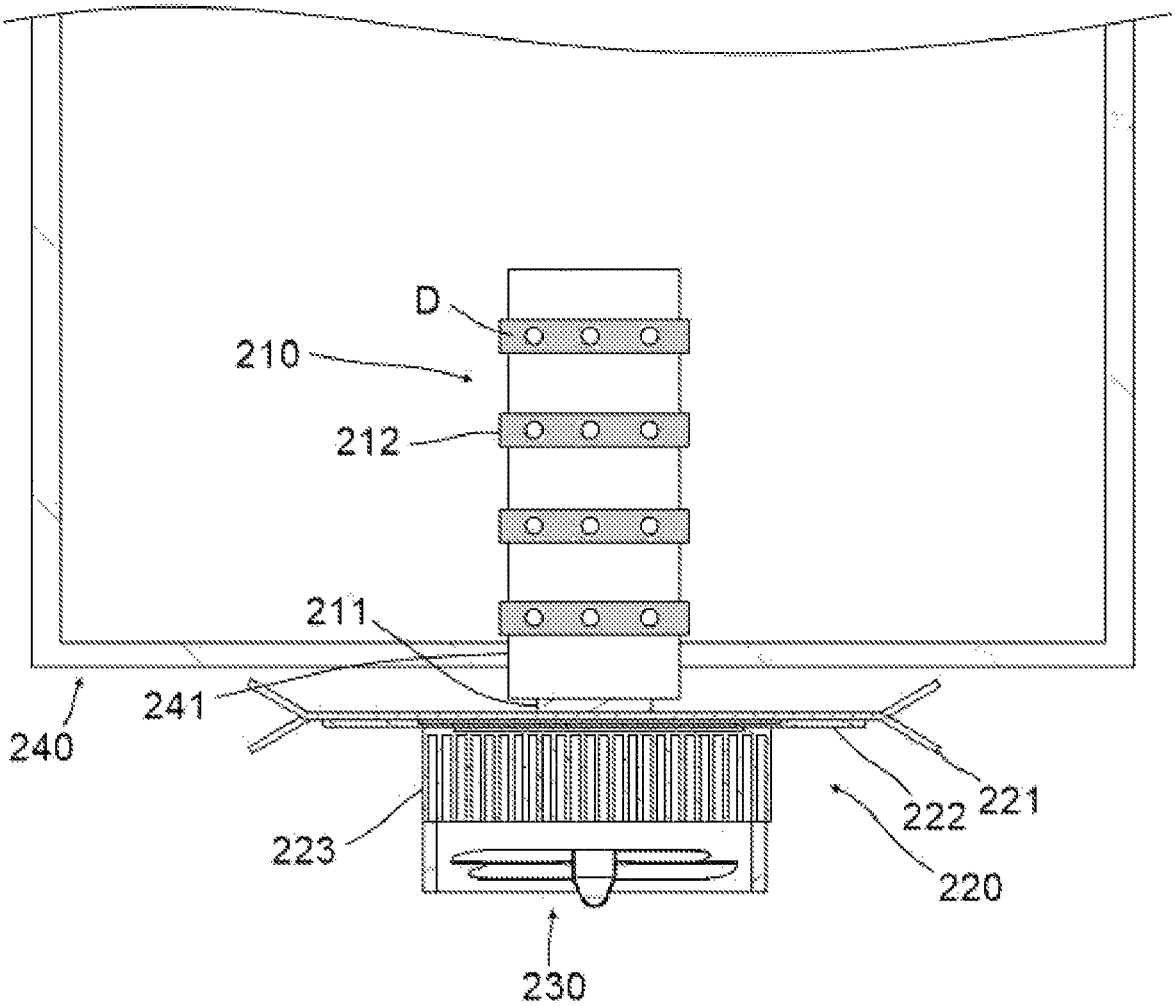
FIG. 8 is an exemplary cross-sectional view of the cooling apparatus and a storage receptacle provided with the cooling apparatus.

FIG. 6 is a perspective view of a second cooling apparatus according to a second embodiment of the present invention, FIG. 7 is an exemplary cross-sectional view of FIG. 6, and FIG. 8 is an exemplary cross-sectional view of the cooling apparatus and a storage receptacle provided with the cooling apparatus.

A second cooling apparatus 200 is installed in a small refrigerator such as a cosmetic refrigerator and a wine refrigerator, and is configured to cool the inside of the refrigerator by a cooling rod, wherein the second cooling apparatus 200 is a device that can increase the cooling efficiency of the cooling rod by attaching a carbon allotrope with high thermal conductivity to a surface of the cooling rod.

The second cooling apparatus 200 includes a cooling rod 210, a heat dissipation part 220, and a cooling fan 230, as shown in FIG. 6 and FIG. 7.

The second cooling apparatus 200 has the cooling rod 210 installed in a storage receptacle 240, in which an object to be cooled (not shown) is stored, so as to cool the object to be cooled, as shown in FIG. 8.

Herein, a cooling rod through hole 241 is formed in a bottom surface of the storage receptacle 240 so that the cooling rod 210 passes through the cooling rod through hole 241.

The cooling rod 210 is formed in a circular rod shape, and a Peltier element 211 is attached to a lower surface thereof.

The Peltier element 211 is an element that operates on the principle that one side is cooled while the other side is heated when a current flows.

A top surface of this Peltier element 211, on which cooling is performed, is attached to the lower surface of the cooling rod 210 so as to cool the cooling rod 210, and a lower surface thereof is attached to an upper surface of the heat dissipation part 220 so as to heat the heat dissipation part 220.

In addition, adhesive elements 212 having carbon allotropes D attached to adhesive surfaces are attached to an outer circumferential surface of the cooling rod 210 at intervals in the vertical direction.

Each of the adhesive elements 212 is formed in the form of a band having an adhesive surface formed on one surface thereof, and attached to the outer circumferential surface of the cooling rod 210 in a ring shape, wherein a plurality of such adhesive elements 212 are attached at intervals in the vertical direction.

Herein, the adhesive elements 212 are preferably thermal conductive tapes having thermal conductivity higher than a general tapes.

In addition, when the adhesive elements 212 are attached, the adhesive elements 212 are attached to the outer circumferential surface of the cooling rod 210 in a state, where the carbon allotropes D are attached to the adhesive surfaces, so that the carbon allotropes D and the outer circumferential surface of the cooling rod 210 come into close contact.

Furthermore, the adhesive elements 212 have a plurality of through holes 2121 which are formed spaced apart from each other in a lengthwise direction. Therefore, when the release of cool air from the cooling rod 210 is blocked by the adhesive elements 212, the cool air is released through the through holes 2121 so that a temperature difference between portions to which the adhesive elements 212 are attached and portions to which the adhesive elements 212 are not attached is prevented from occurring.

Herein, the carbon allotrope D includes layer-separated graphite powder.

Graphite is one of carbon allotropes with excellent thermal conductivity and electrical conductivity, and is composed of a plurality of layers.

Such graphite has anisotropy in which thermal conductivity in the plane direction of each layer is higher than thermal conductivity in the layer direction.

That is, since graphite has relatively low thermal conductivity in the layer direction and the thermal conductivity decreases as the number of layers increases, if the number of layers is decreased, the thermal conductivity can be increased.

In methods for separating the layers of graphite, a physical exfoliation method of exfoliating the layers of graphite by using a tape is used.

In the method of physically exfoliating graphite used herein, if the adhesive surface of an adhesive element 212 and the adhesive surface of another adhesive element are attached and detached in a state in which powdered graphite is attached to the adhesive surface of the adhesive element 212, the graphite layers are exfoliated because the adhesive force of the adhesive elements is stronger than the bonding force between the graphite layers.

The carbon allotrope D has high thermal conductivity because the carbon allotrope D is made of exfoliated graphite powder.

That is, the carbon allotrope D from which the carbon layer is separated is fixed in contact with the outer circumferential surface of the cooling rod 210 by the adhesive element 212, and has high thermal conductivity, thereby increasing cooling efficiency of the cooling rod 210.

Herein, it is preferable to use graphene among various types of carbon allotropes. Graphene means a carbon allotrope separated into one layer when graphite is exfoliated by the adhesive force of the adhesive elements. Since carbon atoms are connected to each other in a hexagonal honeycomb shape and form a two-dimensional planar structure, such graphene is composed of one layer, exhibiting high thermal conductivity.

The cooling rod 210 configured as described above is cooled by the Peltier element 211, and the adhesive elements 212 to which the carbon allotropes D are bonded are attached to the cooling rod 210, thereby increasing cooling efficiency.

Herein, the cooling rod 210 has cooling efficiency higher than conventional cooling rods, since the portions to which the adhesive elements 212 are attached have a relatively high temperature due to the limitation of the release of cold air by the adhesive elements 212, wherein cold air is released through the through holes 2121 formed in the adhesive elements 212 and the portions where the adhesive elements 212 are not attached.

The heat dissipation part 220 includes a cross-shaped first heat sink 221, a square flat plate-shaped second heat sink 222, and a heat radiation fin structure 223.

In this case, it is preferable that the first heat sink 221 and the second heat sink 222 are made of copper, silver, graphene, or the like, having higher thermal conductivity than aluminum used in conventional heat sinks.

The first heat sink 221 is formed of a cross-shaped plate material, and is installed directly below the Peltier element 211 so that an upper surface thereof is in contact with the Peltier element 211.

In addition, the upwardly inclined plates 2211 and downwardly inclined plates 2212 are connected to end portions of the first heat sink 221 so as to cross each other, so that a surface area of the first heat sink 221 is increased due to the upwardly inclined plates 2211 and downwardly inclined plates 2212 and heat dissipation efficiency is increased.

This first heat sink 221 emits heat into the atmosphere through the upwardly inclined plates (2211) and downwardly inclined plates 2212 connected to the end portions thereof, wherein heat that is not emitted is transferred to the second heat sink 222 disposed directly below.

Herein, when the first heat sink 221 is installed, the end portions thereof are disposed to protrude outward from the second heat sink 222, so that the heat at the end portions is not transferred to the second heat sink 222 and is discharged into the atmosphere.

In addition, even though it is described herein, as an example, that the first heat sink 221 is formed in a cross shape and has the upwardly inclined plates 2211 and downwardly inclined plates 2212 connected to the end portions thereof so as to increase the surface area, but the shape of the first heat sink 221 is not limited thereto and may be formed in various shapes to increase the surface area.

The second heat sink 222 is formed in a square flat plate shape, and has an upper surface that is in contact with a lower surface of the first heat sink 221 and a lower surface that is installed so as to come into contact with an upper surface of the heat radiation fin structure 223.

Herein, the second heat sink 222 is formed to have a larger area than an upper plate 2231 of the heat radiation fin structure 223 and is installed to cover the upper plate 2231 of the heat radiation fin structure 223 during assembly.

The second heat sink 222 serves to discharge heat into the atmosphere and transfer heat from the first heat sink 221 to the heat radiation fin structure 223.

In addition, a powder insertion groove 2221 is formed on the upper surface of the second heat sink 222, and a carbon allotrope D is inserted into the powder insertion groove 2221.

At this time, since the inserted carbon allotrope D has high thermal conductivity, heat from the first heat sink 121 is quickly transferred to the second heat sink 122, increasing heat dissipation efficiency.

The heat radiation fin structure 223 includes the upper plate 2231 having a square flat plate shape and a plurality of heat radiation fins 2232 connected to a lower surface of the upper plate 2231.

The upper plate 2231 is formed in the shape of a square flat plate and has a powder insertion groove 22311 formed on an upper surface thereof so that a carbon allotrope D is inserted into the powder insertion groove 22311.

Herein, the inserted carbon allotrope D has high thermal conductivity, and thus allows heat of the second heat sink 222 to be quickly transferred to the upper plate 2231, thereby increasing heat dissipation efficiency.

In addition, a plurality of flat plate-shaped heat radiation fins 2232 are vertically connected to the lower surface of the upper plate 2231 of the heat radiation fin structure 223.

The heat radiation fin structure 223 receives heat from the second heat sink 222 through the upper plate 2231, and a heat transfer rate is increased by the carbon allotrope D inserted into the powder insertion groove 22311, thereby increasing heat dissipation efficiency.

In addition, the heat radiation fin structure 223 radiates heat received from the second heat sink 222 into the atmosphere through the heat radiation fins 1232.

The heat dissipation part 220 configured as described above primarily releases heat from the Peltier element 211 into the atmosphere through the first heat sink 221 formed in a cross shape, and releases the remaining heat into the atmosphere by the second heat sink 122 and the heat radiation fin structure 223.

Therefore, the heat dissipation part 220 can reduce equipment cost by reducing the area of the first heat sink 221 and the second heat sink 222, which are made of relatively expensive materials, and increase cooling efficiency by increasing the surface area.

The cooling fan 230 is installed below the heat radiation fin structure 223 and cools the heat radiation fin structure 223 so as to allow the heat from the Peltier element 211 to be more quickly discharged to the outside, thereby facilitating the cooling process of the cooling rod 210.

In the second cooling apparatus 200 configured as described above, the cooling rod 210 is inserted into the cooling rod through hole 241 formed in the storage receptacle 240 so as to cool an object to be cooled stored inside the storage receptacle 240. In addition, cooling efficiency is increased by the carbon allotrope D attached to the outer circumferential surface of the cooling rod 210.

Moreover, the area of the second cooling apparatus 200 is increased by the first heat sink 221 and the second heat sink 222 installed between the heat radiation fin structure 223 and the Peltier element 211, and thus heat dissipation efficiency is increased.

Figure 9:
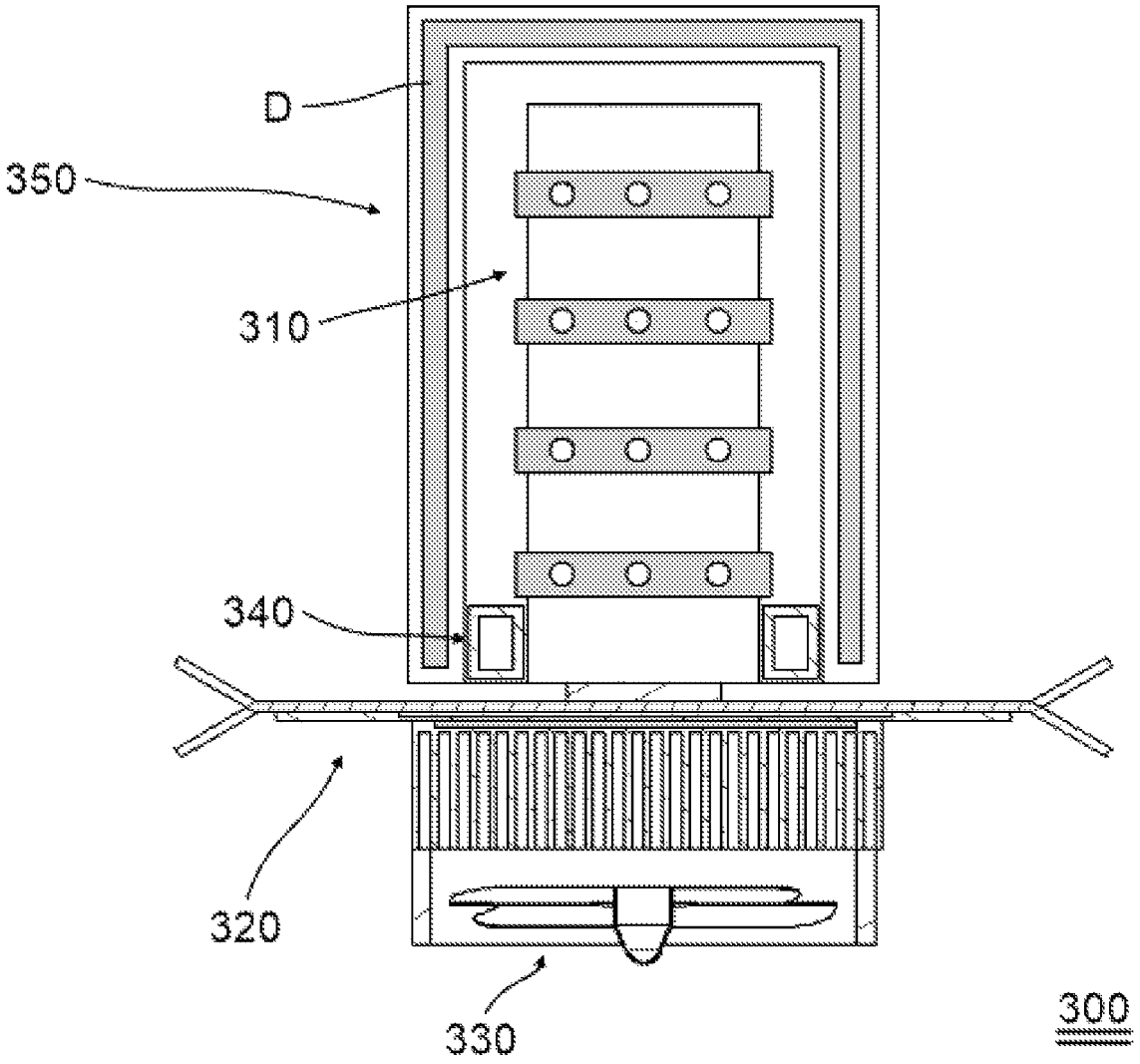
FIG. 9 is a cross-sectional view of a third cooling apparatus according to a third embodiment for a first cooling apparatus shown in FIG. 2.

FIG. 9 is a cross-sectional view of a third cooling apparatus according to a third embodiment for the first cooling apparatus of FIG. 2.

A third cooling apparatus 300 includes a cooling rod 310, a heat dissipation part 320, a cooling fan 330, an auxiliary cooling ring 340, and a cooling tube body 350.

Herein, the cooling rod 310, the heat dissipation part 320 and the cooling fan 330 have the same shape and structure as the cooling rod 210, the heat dissipation part 220, and the cooling fan 230 of FIG. 6.

This third cooling apparatus 300 is a device in which cooling efficiency is increased by additionally installing the auxiliary cooling ring 340 and the cooling tube body 350 outside the cooling rod 310 so as to increase cooling efficiency.

The auxiliary cooling ring 340 is formed in a ring shape with a cavity formed therein, and is installed such that the cooling rod 310 passes through the cavity inside the auxiliary cooling ring 340, wherein the auxiliary cooling ring 340 is installed such that a lower end portion thereof comes into contact with a lower surface of the storage receptacle 240 during installation.

At this time, the auxiliary cooling ring 340 is installed so that an inner circumferential surface thereof comes into contact with an outer circumferential surface of the cooling rod 310, and the cavity inside the auxiliary cooling ring 340 is filled with water.

Since the auxiliary cooling ring 340 is installed adjacent to the Peltier element 311 so that when cooling of the cooling rod 310 starts, the water filled inside is quickly cooled to form ice. In addition, the inner circumferential surface of the auxiliary cooling ring 340 is in contact with the cooling rod 310 so that cooling of the cooling rod 310 is performed not only by the Peltier element 311 but also by the auxiliary cooling ring 340.

In addition, the auxiliary cooling ring 340 absorbs fusion heat even when the operation of the Peltier element 311 is stopped due to a power failure or the like, thereby preventing the temperature inside the storage receptacle from rising for a certain period of time.

It is described herein that water is filled in the auxiliary cooling ring 340 as an example, but an auxiliary cooling solution may be filled instead of water.

The cooling tube body 350 is formed in a circular tube shape with an upper end closed and is made of red clay, wherein salt is added therein during the manufacturing process so as to prevent mold from occurring due to moisture.

For convenience of description, it is described herein that the cooling tube body 350 is described as being made of red clay as an example, but materials for manufacturing the cooling tubular body 350 are not limited thereto and may be made of various types of materials such as charcoal and ceramics.

In addition, since the inside of the cooling tube body 350 is filled with the carbon allotrope D, cooling is performed quickly by the cold air emitted from the cooling rod 310, and increase in temperature due to heat introduced from the outside is reduced.

Furthermore, in the case of the cooling rod 310, since the cooling rod 310 is cooled by the Peltier element (311) attached to a lower end portion thereof, a temperature difference occurs between the lower end portion and an upper end portion in the cooling rod 310, causing a problem that an object to be cooled inside the storage receptacle 240 is not uniformly cooled.

The cooling tube body 350 is configured to be cooled by cool air emitted from the cooling rod 310 and to be evenly cooled by the carbon allotrope D filled inside, so that an object to be cooled inside the storage receptacle 240 can be prevented from being non-uniformly cooled.

In addition, the cooling tube body 350 prevents the object to be cooled from being supercooled by direct contact with the cooling rod 310, thereby preventing the object to be cooled from being damaged or deformed by the supercooling.

Figure 10:
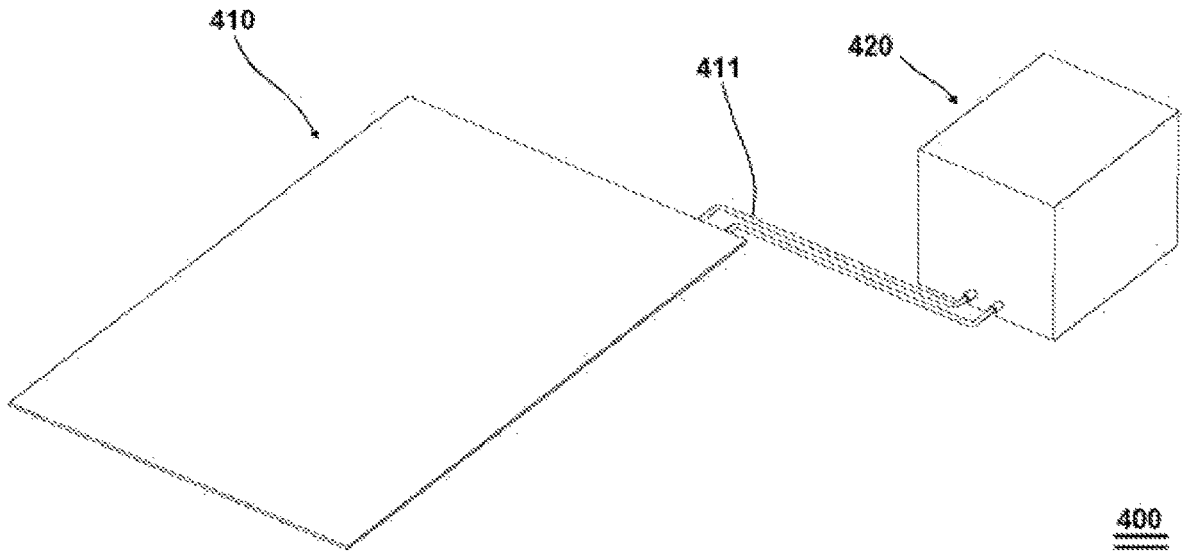
FIG. 10 is a perspective view of a fourth cooling apparatus according to a fourth embodiment for the first cooling apparatus of FIG. 2.

FIG. 10 is a perspective view of a fourth cooling apparatus according to a fourth embodiment for the first cooling apparatus of FIG. 2.

A fourth cooling apparatus 400 is a device that lowers temperature of a mat by circulating cooled water through a circulation pipe installed inside the mat.

The fourth cooling apparatus 400 includes, as shown in FIG. 10, a mat part 410 in which a circulation pipe 411 is installed so as to allow cold water to circulate therethrough, and a cold water circulation part 420, which cools water and, at the same time, circulates cold water inside the circulation pipe 411.

The mat part 410 is a mat in which the circulation pipe 411 is installed, as shown in FIG. 10.

The circulation pipe 411 is configured to be connected to the cold water circulation part 420 so as to circulate cold water therein, wherein the temperature of the mat part 410 is reduced by the cold water circulating therein.

Herein, a carbon allotrope (not shown) is inserted into the mat part 410.

The carbon allotrope includes layer-separated graphite powder.

Graphite is one of carbon allotropes with excellent thermal conductivity and electrical conductivity, and is composed of a plurality of layers.

Such graphite has anisotropy in which thermal conductivity in the plane direction of each layer is higher than thermal conductivity in the layer direction.

That is, since graphite has relatively low thermal conductivity in the layer direction and the thermal conductivity decreases as the number of layers increases, if the number of layers is decreased, the thermal conductivity can be increased.

In the methods for separating the layers of graphite, a physical exfoliation method of exfoliating the layers of graphite by using a tape is used.

In the method of physically exfoliating graphite used herein, if the adhesive surface of an adhesive element and the adhesive surface of another adhesive element are attached and detached in a state in which powdered graphite is attached to the adhesive surfaces of the adhesive elements, the graphite layers are exfoliated because the adhesive force of the adhesive elements is stronger than the bonding force between the graphite layers.

The carbon allotrope has high thermal conductivity because the carbon allotrope is made of exfoliated graphite powder.

That is, the carbon allotrope from which the carbon layer is inserted into the mat part 410 and has high thermal conductivity, thereby increasing cooling efficiency of the mat part 410.

Temperature of this mat part 410 is reduced by the cold water circulating inside the circulation pipe 411, so that the body temperature of a user using the mat part 410 can be lowered, wherein cooling efficiency is increased by the carbon allotrope inserted inside.

Figure 11:
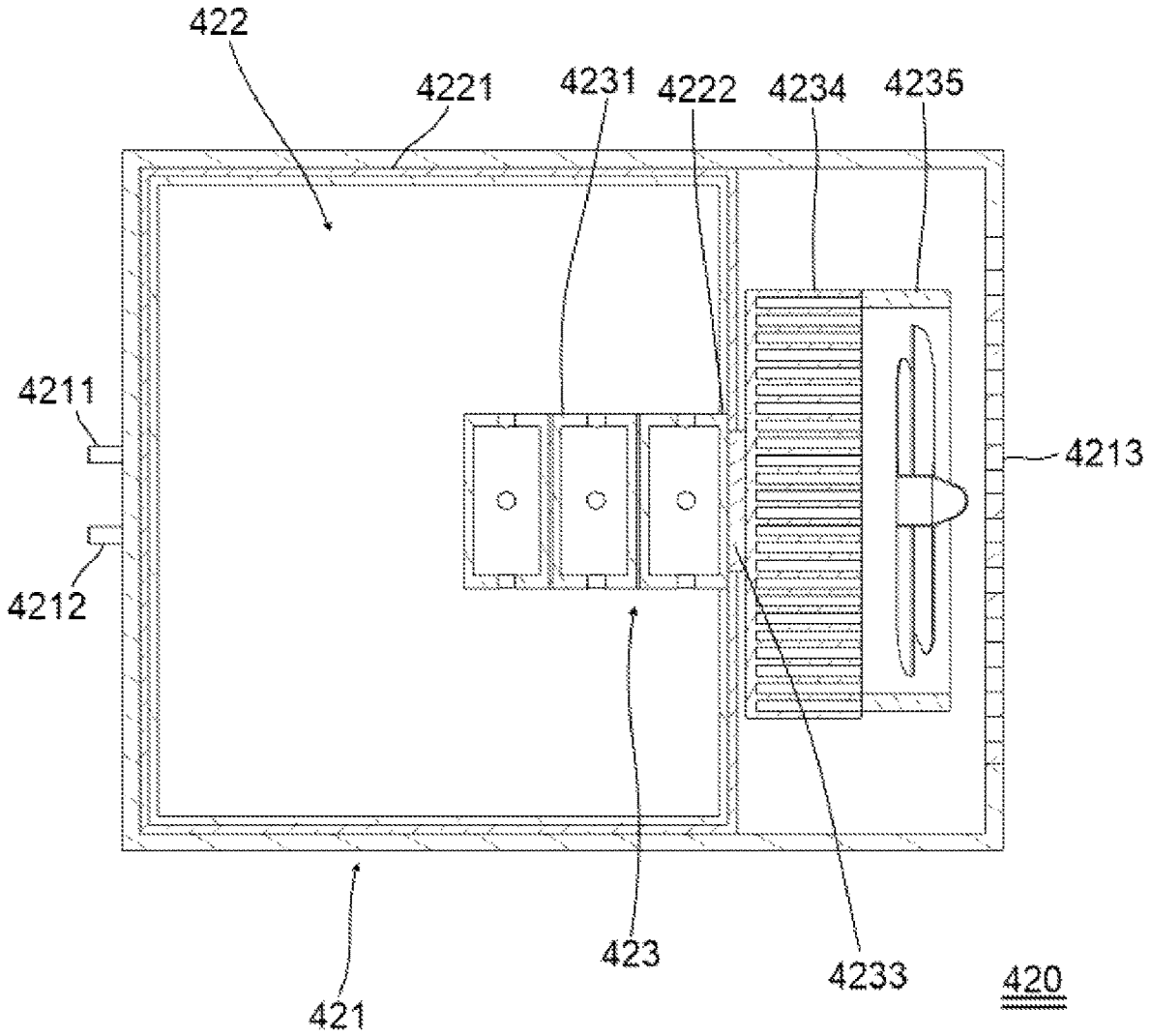
FIG. 11 is a cross-sectional view of a cold water circulation part shown in FIG. 10.

FIG. 11 is a cross-sectional view of the cold water circulation part of FIG. 10.

The cold water circulation part 420 includes a case 421, a cold water container 422 installed inside the case 421 and receiving cold water therein, and a cooling part 423 for cooling water received inside the cold water container 422, as shown in FIG. 11.

The case 421 is formed in an enclosure shape with a space formed therein, and the cold water container 422, the cooling part 423, and a motor (not shown) are installed therein.

In addition, a water outlet part 4211 and a recovery part 4212 connected to the cold water container 422 are installed on the front of the case 421.

The water outlet part 4211 is connected to one end of the circulation pipe 411, and cold water received in the cold water container 422 is discharged to the circulation pipe 411 by the motor (not shown).

The recovery part 4212 is connected to the other end of the circulation pipe 411, and the cold water discharged to the circulation pipe 411 through the water outlet part 4211 is recovered.

Furthermore, a discharge plate 4213 is installed on a rear surface of the case 421.

The discharge plate 4213 is formed in a plate shape and has a plurality of discharge holes 42131 formed in oblique lines.

The discharge plate 4213 allows heat to be discharged to the outside from a heat sink structure 4234 of the cooling part 423, which is described hereinafter.

The cold water container 422 is formed in an enclosure shape with a space for receiving water therein, and water contained therein is cooled by the cooling part 423.

Herein, the cold water container 422 is installed adjacent to the front of the case 421 and has a rear surface installed to be spaced apart from the discharge plate 4213 of the case 421, so that a space can be formed between the rear surface of the cold water container 422 and the discharge plate 4213 of the case 421 and the cooling part 423 and the motor (not shown) can be installed in the space.

In addition, an insulation material 4221 is installed on the outside of the cold water container 422.

The insulation material 4221 is installed to surround the cold water container 422, thereby preventing cold air from the cold water container 422 from being discharged to the outside and heat from the heat sink structure 4234 from being introduced into the cold water container 422.

The insulation material 4221 prevents cold air from the cold water container 422 from being discharged to the outside and, at the same time, prevents heat from the heat sink structure 4234 or from the outside from entering the inside of the cold water container 422, thereby enabling not only the cooling efficiency of the water received in the cold water container 422 to be increased, but also the cooling state of the cold water to be maintained for a long period of time even when the cooling of the cooling part 423 is stopped.

Furthermore, the cold water container 422 has a through hole 4222 formed in the rear surface thereof so that a cooling rod 4231, which is described hereinafter, passes through the through hole 4222.

Figure 12:
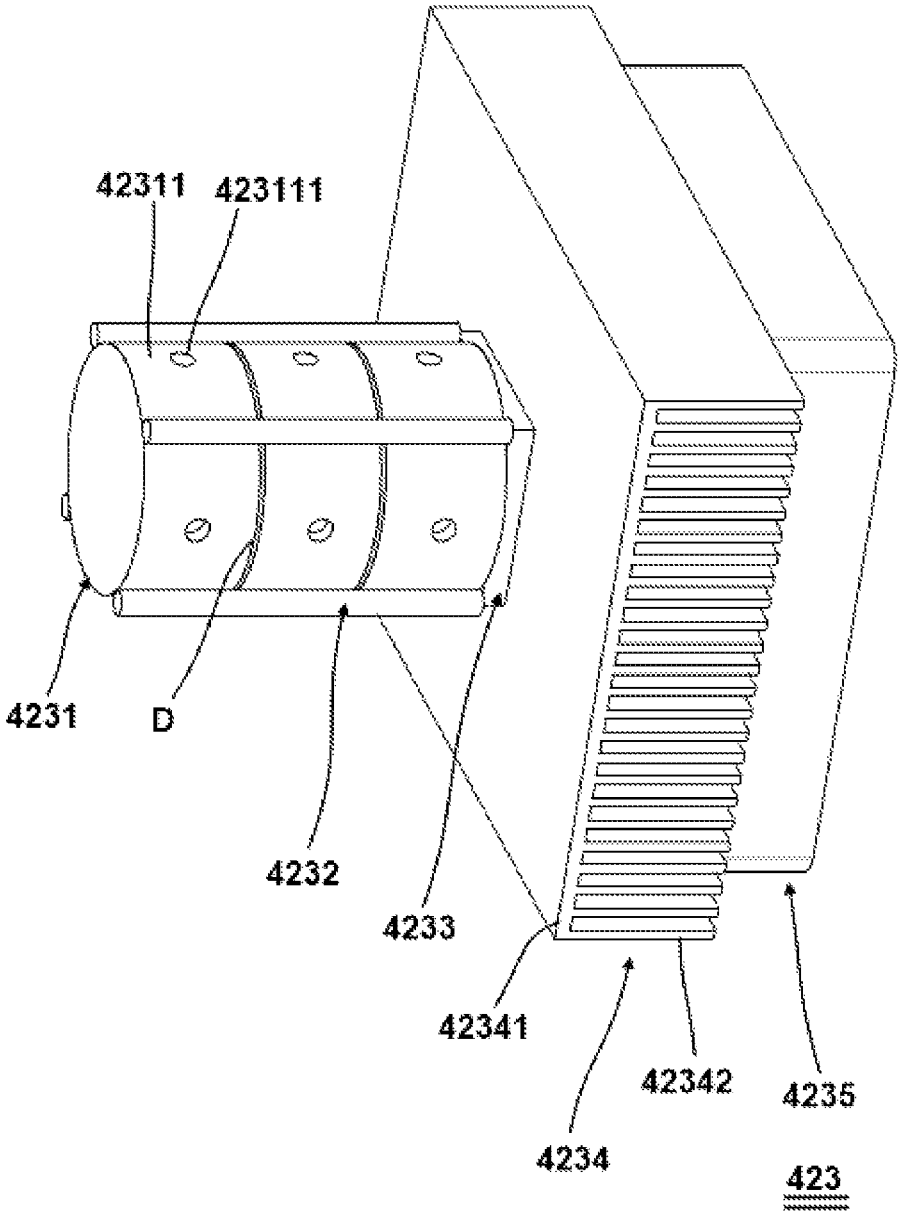
FIG. 12 is a perspective view of a cooling part shown in FIG. 11.

FIG. 12 is a perspective view of the cooling part of FIG. 11.

The cooling part 423 includes the cooling rod 4231 installed inside the cold water container 422, cooling tubes 4232, a thermoelectric element 4233, a heat sink structure 4234, and a cooling fan 4235, as shown in FIG. 12.

The cooling rod 4231 is formed in a circular rod shape in which a plurality of ice buckets 42311 are stacked, and is disposed inside the cold water container 422 by passing through the through hole 4222 formed in the cold water container 422. In addition, the thermoelectric element 4233 is attached to a rear end portion of the cooling rod 4231.

Herein, the cooling rod 4231 includes carbon allotropes D inserted between the ice buckets 42311, and since carbon allotropes D have high thermal conductivity, cold air from the ice bucket disposed at a rear end portion is quickly transferred to the ice bucket disposed at the front.

The ice buckets 42311 are formed in a cylindrical shape with a space formed therein and have inlet holes 423111 formed at intervals in the circumferential direction in outer circumferential surfaces thereof so that water is introduced into the ice buckets 42311 through the inlet holes 42311.

In addition, the ice buckets 42311 have each inner wall surface made of a material with high thermal conductivity. Therefore, when cooling is performed by the thermoelectric element 4233, the temperature of the inner wall surface decreases faster than that of water, so that ice is formed inside the ice buckets 42311 from the inner wall surface having a low temperature.

Herein, since the thermoelectric element 4233 is attached to a rear surface of the ice bucket 4231 placed at the rearmost position (hereinafter, referred to as the "rearmost ice bucket") among the ice buckets 4231, the cold air of the thermoelectric element 4233 is directly transmitted to the rearmost ice bucket. Therefore, even if the temperature inside the cold water container 422 is high, the rearmost ice bucket can be sufficiently cooled to a temperature for making ice.

As a result, even if the external temperature of the case 421 rises up to 30 to 40° or higher, the rearmost ice bucket is cooled to a temperature of 0° or less by the thermoelectric element 4233, and ice is formed therein. In addition, the ice bucket disposed in front of the rearmost ice bucket is cooled down to 0° or less by the ice generated inside the rearmost ice bucket and cold air transmitted from the thermoelectric element 4233, and ice is formed therein.

The cooling rod 4231 configured as described above is cooled by the thermoelectric element 4233 attached to the rear surface of the rearmost ice bucket, and ice is formed therein. The cool air of the thermoelectric element 4233 and the ice formed inside the rearmost ice bucket is transmitted to the front, so that ice is sequentially formed inside the ice buckets placed in front of the rearmost ice bucket. Therefore, even when the external temperature is high, ice can be formed inside the ice buckets 42311.

In addition, since ice is formed inside the ice buckets 42311, the cooling rod 4231 is maintained at a temperature lower than or equal to a certain temperature, so that the water contained in the cold water container 422 can be cooled to a certain temperature.

Furthermore, the cooling rod 4231 is disposed in a front and rear direction inside the cold water container 422 so that a contact area with respect to the water contained in the cold water container 422 is increased, thereby cooling a large area at the same time and increasing a cooling rate. In addition, the water contained in the cold water container 422 can be uniformly cooled.

The cooling tubes 4232 are rod-shaped tubes into which an auxiliary cooling solution and cotton are inserted, wherein one end portion of each of the cooling tubes 4232 is coupled to a rear surface of the cold water container 422 and an outer circumferential surface thereof is installed so as to come into contact with an outer circumferential surface of the cooling rod 4231.

Herein, the auxiliary cooling solution filled in the cooling tubes 4232 is a solution composed of 70 to 80 wt % of acetic acid and 20 to 30 wt % of salt.

Since the auxiliary cooling solution has high thermal conductivity and heat capacity when salt is dissolved in acetic acid, the cooling tubes 4232 into which the auxiliary cooling solution is inserted have increased high thermal conductivity and heat capacity, thereby increasing cooling efficiency.

In addition, since the auxiliary cooling solution is inserted into the cooling tubes 4232 in a state absorbed by the cotton, a storage period of the auxiliary cooling solution is increased compared to when it is inserted in a solution form.

This auxiliary cooling solution has not only high thermal conductivity but also a large heat capacity, so that the auxiliary cooling solution maintains a cooling state for a long time even if the outside temperature decreases. Therefore, even when cooling of the thermoelectric element 423 is stopped due to a power failure, a breakdown or the like, the auxiliary cooling solution maintains the cooling state of the cooling tubes 4232, thereby increasing the time required for the temperature of the cooling rod 4231 installed in contact with the cooling tubes 4232 to rise.

Since the cooling tubes 4232 are installed in contact with the outer circumferential surface of the cooling rod 4231, the auxiliary cooling solution filled in the cooling tubes 4232 is cooled by the cooling rod 4231.

Since the cooling tubes 4232 configured as described above are installed to come into contact with the outer circumferential surface of the cooling rod 4231, the auxiliary cooling solution filled inside the cooling tubes 4232 is cooled by the cold air of the cooling rod 4231.

Herein, the auxiliary cooling solution has not only high thermal conductivity but also a large heat capacity, so that the auxiliary cooling solution maintains a cooling state for a long time even if the outside temperature decreases. Therefore, even when cooling of the thermoelectric element 4233 is stopped due to a power failure, a breakdown or the like, the auxiliary cooling solution maintains the cooling state of the cooling tubes 4232, thereby decreasing a speed at which the temperature of the water received in the cold water container 422 rises.

The thermoelectric element 4233 is an element that operates on the principle that one side is cooled while the other side is heated when a current flows.

One side of this thermoelectric element 4233 is attached to the rear end portion of the cooling rod 4231 so as to cool the cooling rod 4231, and the other side is attached to a front surface of the heat sink structure 4234 so as to heat the heat sink structure 4234.

The heat sink structure 4234 includes a flat plate-shaped heat dissipation frame 42341 with the thermoelectric element 4233 attached to a front surface thereof, and a plurality of flat plate-shaped heat sinks 42342 vertically coupled to a rear surface of the heat dissipation frame 42341.

The heat sink structure 4234 receives heat generated by the Peltier element 4233 through the heat dissipation frame 42341 and releases the heat into the air through the heat sinks 42342.

The cooling fan 4235 is installed below the heat sink structure 334 and releases the heat of the heat sink structure 4234 to the outside through the discharge plate 4213 installed on the rear surface of the case 421, so that the heat of the thermoelectric element 4233 can be more quickly discharged to the outside and the cooling process of the cooling rod 4231 can be performed smoothly.

The cooling part 423 configured as described above is cooled by the thermoelectric element 4233 attached to the rear end portion of the cooling rod 4231 disposed inside the cold water container 422. Therefore, the ice buckets 3311 of the cooling rod 4231 sequentially produce ice from the rear to the front.

This cooling rod 4231 is maintained in a cooled state at a temperature lower than or equal to a certain temperature by the ice generated therein, thereby cooling water. In addition, the cooling rod 4231 is disposed in the front and rear direction inside the cold water container 4232, thereby increasing the contact area with water and uniformly cooling the water received in the cold water container 422.

Furthermore, since the cooling rod 423 includes carbon allotropes D inserted between the ice buckets 42311, the transfer speed of cold air generated between the ice buckets 42311 is accelerated so that the time required for ice to be formed in the ice bucket disposed at a forefront position can be reduced.

In addition, even if the cooling of the thermoelectric element 4233 is stopped due to a power failure, a breakdown or the like, cold air is maintained for a long time by the ice generated inside the cooling rod 4231 and the auxiliary cooling solution filled in the cooling tubes 4232, so that the temperature of the water received in the cold water container 422 can be maintained low in a cold state for a longer time.

Figure 13:
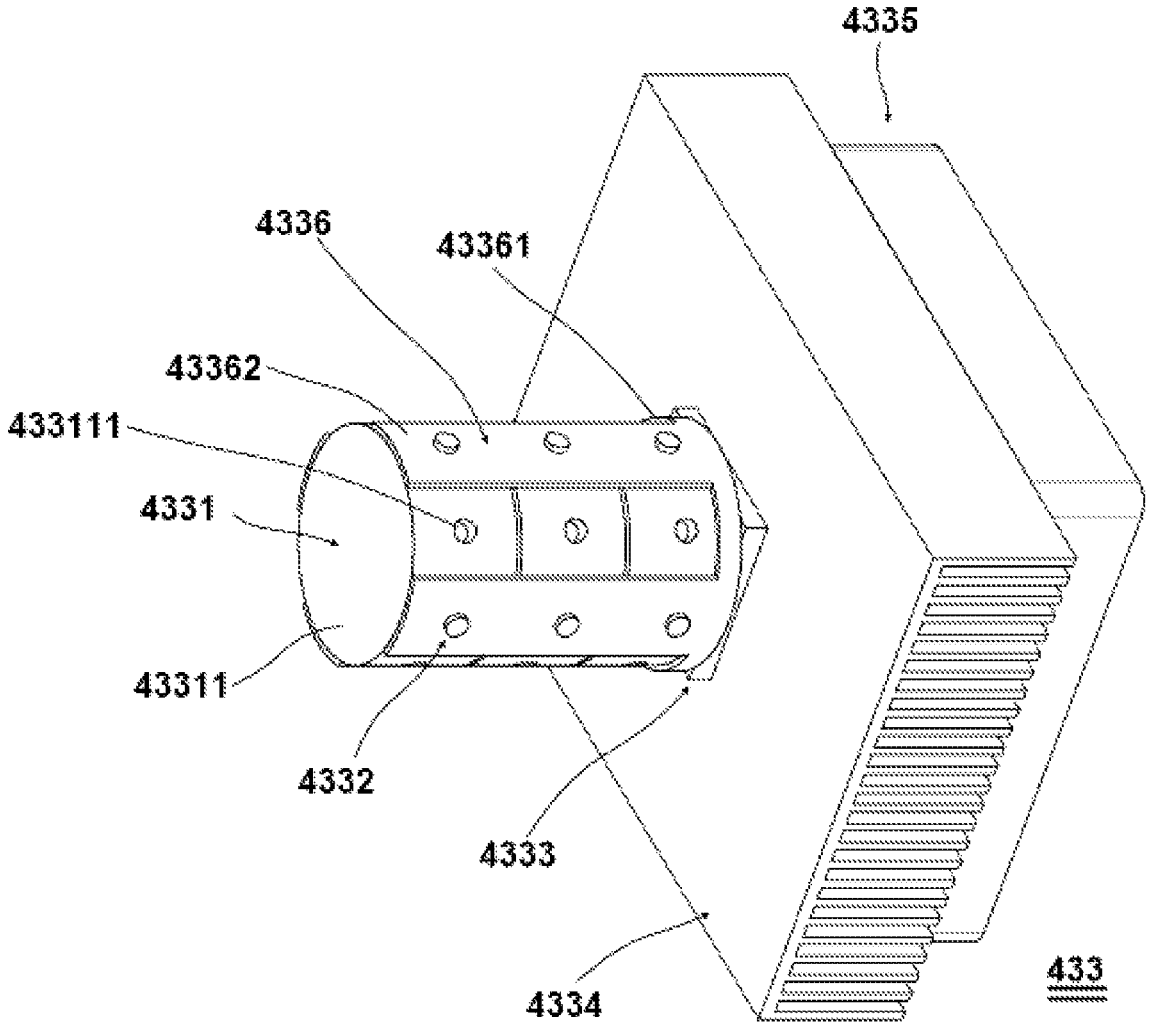
FIG. 13 is a perspective view of a second cooling part according to a second embodiment for the cooling part of FIG. 12.
Figure 14:
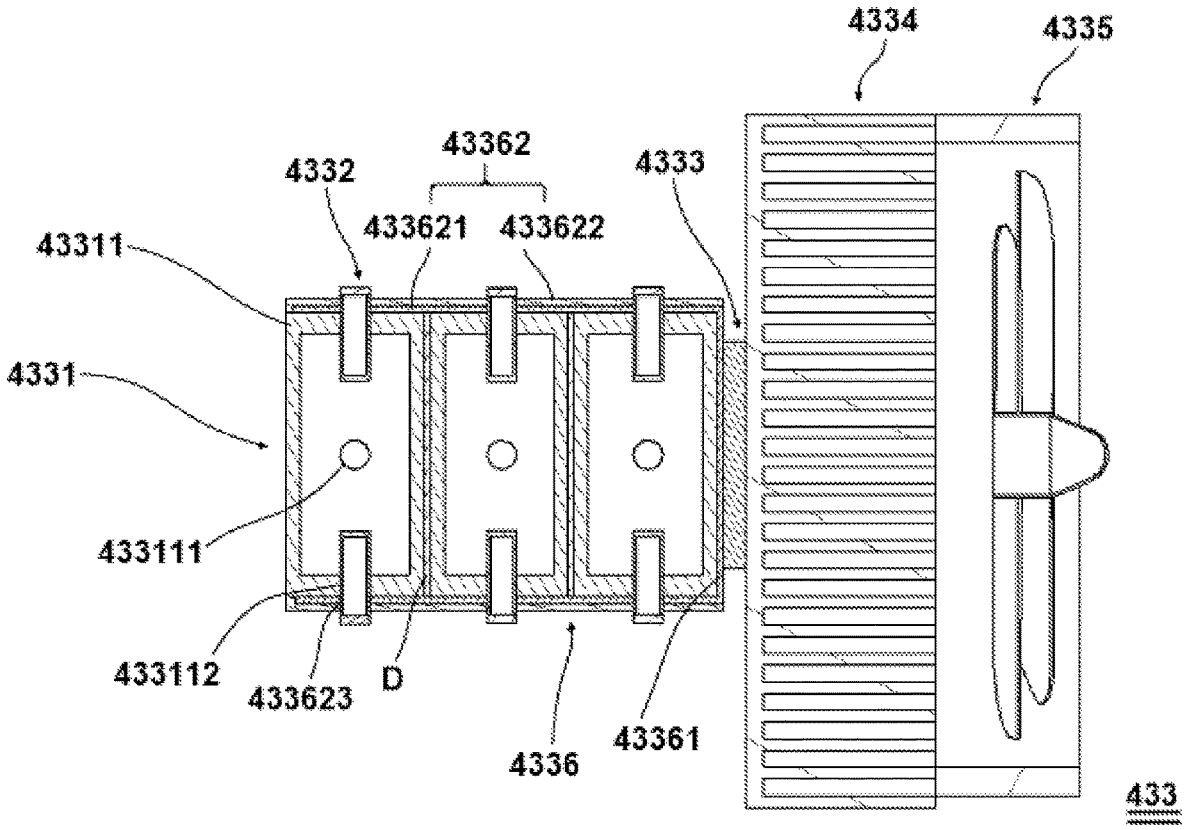
FIG. 14 is a cross-sectional view of FIG. 13.

FIG. 13 is a perspective view of a second cooling part according to a second embodiment for the cooling part of FIG. 12, and FIG. 14 is a cross-sectional view of FIG. 13.

A second cooling part 433 includes a second cooling rod 4331, second cooling tubes 4332, a second thermoelectric element 4333, a heat sink structure 4334, a cooling fan 4335, and a cold air transfer part 4336, as shown in FIG. 13.

Herein, the heat sink structure 4334 and the cooling fan 4335 of the second cooling part 433 have the same shape and structure as the heat sink structure 4334 and the cooling fan 4335 of the cooling part 423 of FIG. 12.

The second cooling rod 4331 is formed in a circular rod shape, in which a plurality of ice buckets 43311 are stacked, and is installed to be disposed inside a cold water container 422 passing through a through hole 4222 formed in the cold water container 422. Herein, the second cooling rod 4331 includes carbon allotropes D inserted between the ice buckets 43311

The ice buckets 43311 are formed in a cylindrical shape with a space formed therein, and have inlet holes 433111 formed in outer circumferential surfaces thereof so that water is introduced into the ice buckets 43311 through the inlet holes 433111, and cooling tube through holes 433112 formed at intervals in the circumferential direction in the outer circumferential surfaces so that the second cooling tubes 4332 pass through the cooling tube through holes 433112.

Herein, the second cooling tubes 4332 are installed to pass through the cooling tube through holes 433112 formed in the ice buckets 43311, respectively, so that the second cooling tubes 4332 are disposed inside the ice buckets 43311.

The second cooling tubes 4332 are rod-shaped tubes filled with an auxiliary cooling solution therein, and are installed to be disposed inside the ice buckets 43311.

Herein, the second cooling tubes 4332 are formed to have a diameter same as that of the cooling tube through holes 433112 formed in the outer circumferential surfaces of the ice buckets 43311, so that when the second cooling tubes 4332 are inserted into the cooling tube insertion holes 433112, the cooling tube insertion holes 433112 are sealed by the second cooling tubes 4332.

In addition, when the second cooling tubes 4332 are installed, portions adjacent to outer end portions are coupled to the cold air transfer part 4336, and inner end portions are installed to be disposed inside the ice buckets 43311.

Since the second cooling tubes 4332 are coupled to the cold air transfer part 4336, the second cooling tubes 4332 are cooled by receiving cold air from the coupled cold air transfer part 4336. In addition, since the second cooling tubes 4332 are disposed inside the ice buckets 43311, the ice buckets 43311 installed apart from the second thermoelectric element 4333 can also be quickly cooled.

Furthermore, the secondary cooling tubes 4332 are filled with the auxiliary cooling solution having a large heat capacity, so that the secondary cooling tubes 4332 can maintain cold air for a long period of time even when the supply of cold air is stopped due to a power failure, a breakdown or the like, thereby preventing the temperature of the water contained in the cold water container 422 from rapidly rising.

The second thermoelectric element 4333 is attached to a rear surface of a cooling plate 43361 of the cold air transfer part 4336 and transfers cold air to the cooling plate 43361.

The cold air transfer part 4336 includes a disc-shaped cooling plate 43361 and a plurality of contact plates 43362 connected to the cooling plate 43361.

The cooling plate 43361 is formed in a disc shape with a front surface coupled to the rear end portion of the second cooling rod 4331 and a rear surface to which the second thermoelectric element 4333 is attached.

Herein, it is preferable that the diameter of the cooling plate 43361 is greater than that of the cooling rod 4331.

In addition, it is preferable that the cooling plate 43361 is formed of a material having high thermal conductivity, so that cold air from the second thermoelectric element 4333 is rapidly diffused.

Furthermore, on the front surface of the cooling plate 43361, the contact plates 43362 protrude forward from an outer end portion at intervals in the circumferential direction.

The contact plates 43362 are formed in the shape of a curved plate having the same curvature as the outer circumferential surface of the second cooling rod 4331, and connected to the front surface of the cooling plate 43361 with rear end portions.

Herein, the contact plates 43362 are installed such that inner circumferential surfaces come into contact with the outer circumferential surface of the second cooling rod 4331. The contact plates 43362 have length in the front and rear direction, smaller than or equal to length of the second cooling rod 4331 so as to be installed such that the inner circumferential surfaces also come into contact with the outer circumferential surface of the ice bucket 43311 placed at a forefront position.

In addition, the contact plates 43362 have a double wall structure with an inner wall 433621 and an outer wall 433622, wherein when installed, the inner wall 433621 comes into contact with the outer circumferential surface of the second cooling rod 4331 and the outer wall 433622 is installed to surround the inner wall 433621 from the outside so as to prevent the inner wall 433621 from coming into direct contact with water.

In the contact plates 43362, the inner walls 433621 are made of a material with high thermal conductivity so as to be rapidly cooled by cold air emitted from the cooling plate 43361, and the outer walls 433622 are made of a material with low thermal conductivity and thus has a temperature relatively higher than that of the inner walls 433621.

Moreover, the contact plates 43362 have cooling tube coupling holes 433623, which are formed through the inner walls 433621 and the outer walls 433622, and to which the second cooling tubes 4332 are coupled.

Herein, the cooling tube coupling holes 433623 are formed at positions corresponding to those of the cooling tube through holes 433112 formed in the second cooling rod 4331.

These contact plates 43362 are configured to evenly transfer cold air from the second thermoelectric element 4333 to the cooling rod 4331 through the inner walls 433621 having high thermal conductivity, thereby enabling the second cooling tubes 4332 coupled to the cooling tube coupling holes 433623 and the second cooling rod 4331 in contact with the inner walls 433621 to be uniformly cooled.

The second cooling part 433 as described above is configured such that when cold air is generated by the second thermoelectric element 4333, the cold air generated from the second thermoelectric element 4333 is evenly transferred to the second cooling rod 4331 through the cold air transfer part 4336, thereby increasing speed at which ice is formed inside the ice buckets 43311 constituting the second cooling rod 4331.

In addition, the second cooling part 433 is configured such that the second cooling tubes 4332 filled with the auxiliary cooling solution are placed inside the ice buckets 43311, thereby increasing the time it takes for the ice produced inside the ice buckets 43311 to melt. Therefore, even if the cooling of the second thermoelectric element 4333 is stopped due to a breakdown, power failure or the like, the second cooling part 433 can maintain cooling for a long time.

Figure 15:
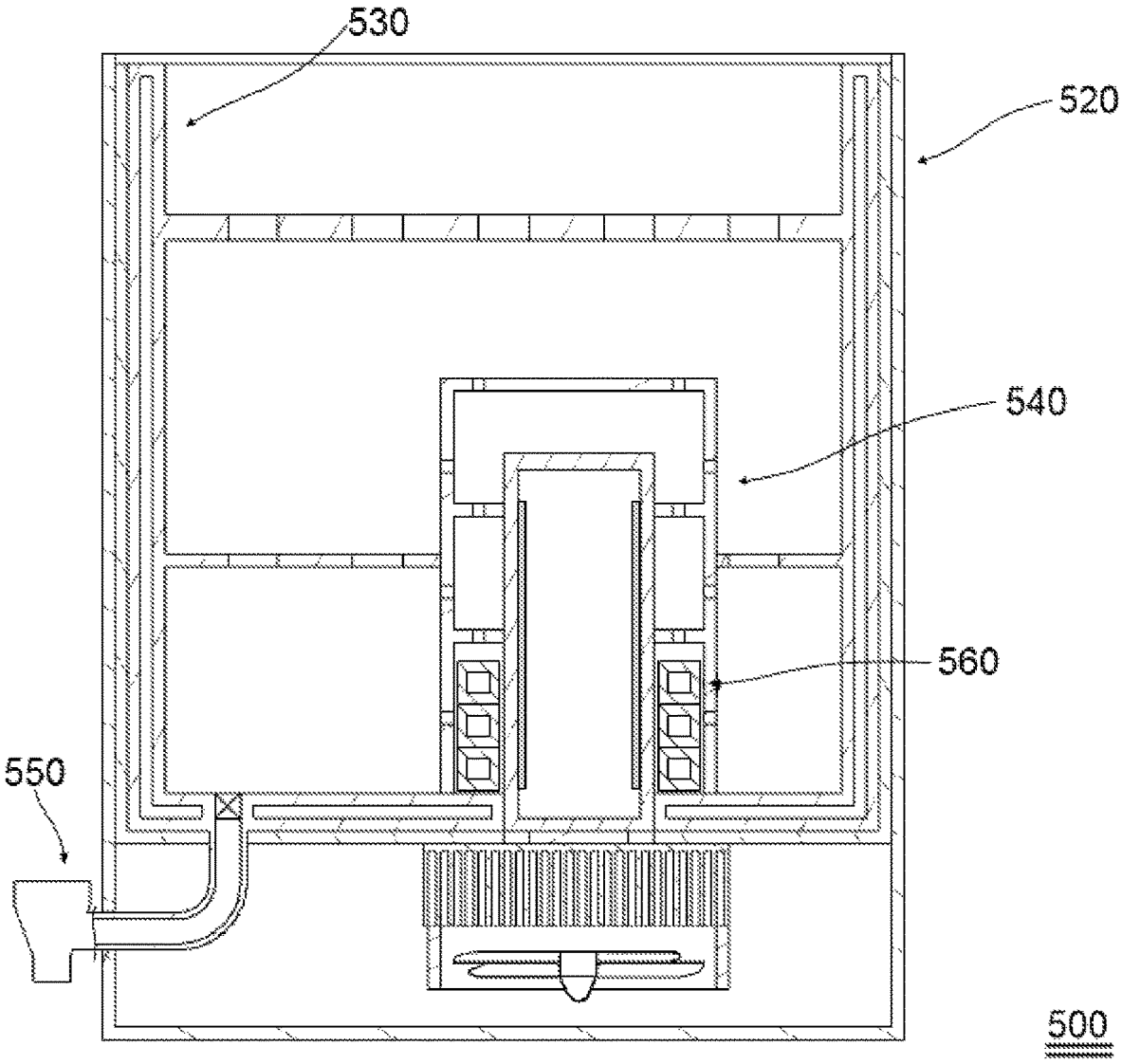
FIG. 15 is a cross-sectional view of a fifth cooling apparatus according to a fifth embodiment for the first cooling apparatus of FIG. 2.
Figure 16:
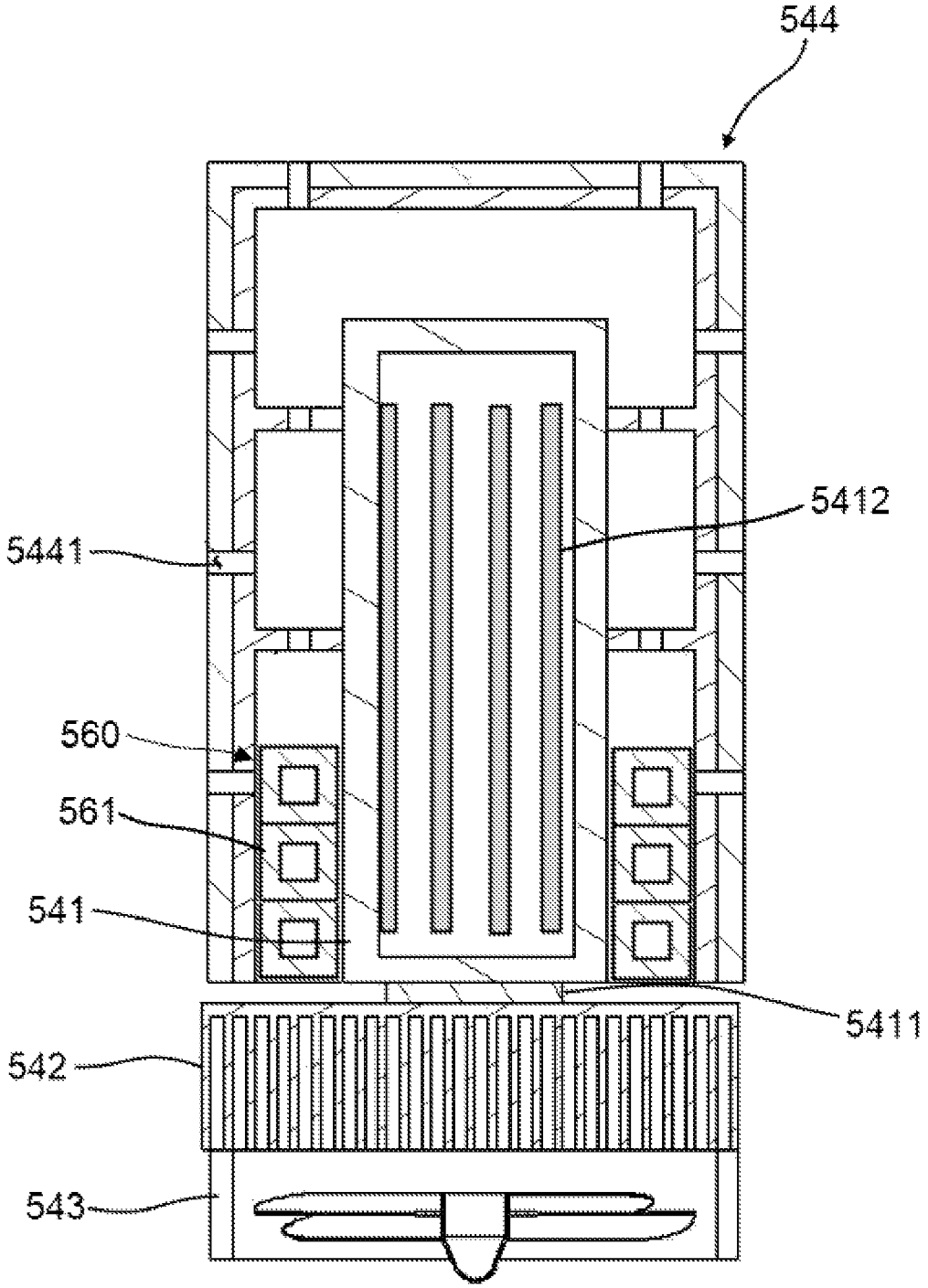
FIG. 16 is a cross-sectional view of a cooling part and an ice making part shown in FIG. 15.

FIG. 15 is a cross-sectional view of a fifth cooling apparatus according to a fifth embodiment for the first cooling apparatus of FIG. 2, and FIG. 16 is a cross-sectional view of a cooling part and an ice making part shown in FIG. 15.

Referring to FIG. 15, a fifth cooling apparatus 500 includes a case 520, a storage receptacle 530, a cooling part 540, a drain part 550, and an ice making part 560.

Herein, the case 520, the storage receptacle 530 and the drain part 550 of the fifth cooling apparatus 500 have the same shape and structure as the case 120, the storage receptacle 130 and the drain part 150 of the first cooling apparatus 100 shown in FIG. 2.

Referring to FIG. 16, the cooling part 540 includes a cooling rod 541, a heat sink structure 542, a cooling fan 543 and a tube body 544.

Herein, the heat sink structure 542 and the cooling fan 543 have the same shape and structure as the heat sink structure 142 and the cooling fan 143 of the first cooling apparatus 100 of FIG. 2.

The cooling rod 541 is formed in a circular rod shape with a space inside, and has a Peltier element 5411 attached to a lower surface.

In addition, adhesive elements 5412 with carbon allotropes D attached to adhesive surfaces are attached to an inner circumferential surface of the cooling rod 541 in the longitudinal direction of the cooling rod 541.

The cooling rod 541 is configured such that the carbon allotropes D attached to the adhesive elements 5412 directly come into contact with an outer circumferential surface of the cooling rod 541, and thus cooling efficiency is increased by the carbon allotropes D.

The tube body 544 is formed in a circular tube shape with a closed upper portion and is installed to surround the cooling rod 541.

In addition, a plurality of through holes 5441 are formed in the tube body 544 so that water can flow in and out.

The ice making part 560 has a stacked shape of a plurality of rings 561 having spaces formed therein.

Herein, the ice making part 560 is configured to be installed at a position adjacent to a lower end portion of the cooling rod 541 so as to be installed at a position adjacent to a Peltier element 5411.

In addition, the ice making part 560 is filled with water inside rings 561.

The ice making part 560 is configured such that when cooling of the cooling rod 541 is started by the Peltier element 5411, ice is produced inside the rings 561 in order from the ring installed adjacent to the Peltier element 5411 among the rings 561. Therefore, the cooling rod 541 is cooled not only by the Peltier element 5411 but also by the ice produced inside the ice making part 560, so that the cooling speed of the cooling rod 541 is increased.

In addition, since ice is produced inside the ice making part 560, even when cooling of the Peltier element 5411 is stopped due to a power failure, a breakdown or the like, increase in temperature inside the cooling rod 541 and the storage receptacle is prevented for a certain period of time by the ice produced inside.

For convenience of description, it is described herein that the ice making part 560 is filled with water as an example, but an auxiliary cooling solution may be filled instead of water.

The fifth cooling apparatus 500 configured as above has the same structure as the first cooling apparatus 100, but the adhesive elements 5412 with the carbon allotropes 541 are attached to the inner circumferential surface of the cooling rod 541 is attached, cooling efficiency is increased compared to that of the first cooling apparatus 100.

In addition, the fifth cooling apparatus 500 is configured such that the ice making part 560 is installed at the lower portion of the cooling rod 541 and thus cooling of the cooling rod 541 is carried out by the ice produced inside the ice making part 560, thereby increasing cooling speed of the cooling rod 541. Furthermore, cold air can be maintained for a long period of time by the ice produced inside the ice making part 560 even when cooling is interrupted due to a power outage or breakdown.

Figure 17:
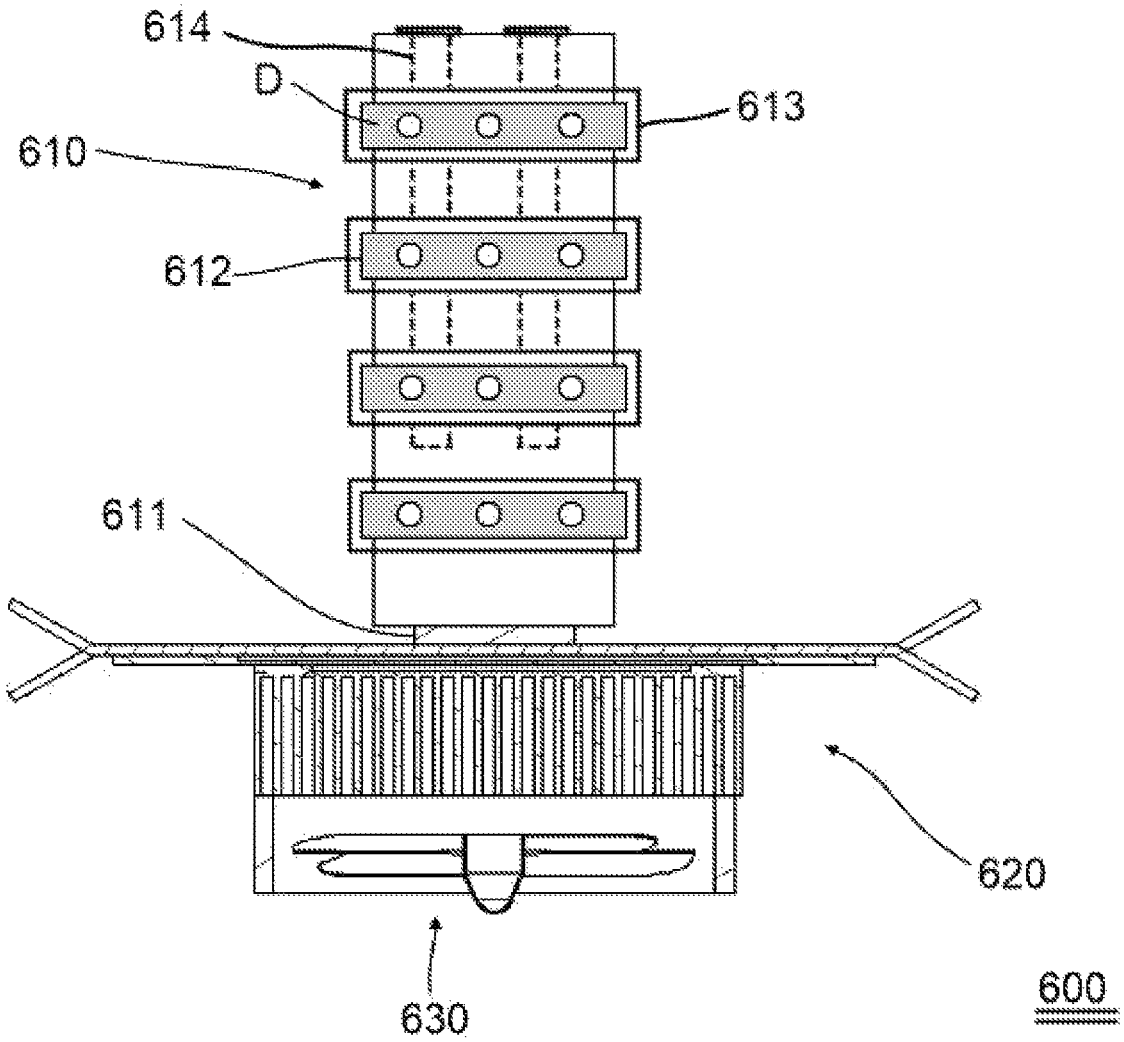
FIG. 17 is a cross-sectional view of a sixth cooling apparatus according to a sixth embodiment for the first cooling apparatus of FIG. 2.

FIG. 17 is a cross-sectional view of a sixth cooling apparatus according to a sixth embodiment for the first cooling apparatus of FIG. 2.

Referring to FIG. 17, a sixth cooling apparatus 600 includes a cooling rod 610, a heat dissipation part 620, a cooling fan 630 and a cooling tube body 650.

Herein, the heat dissipation part 620 and the cooling fan 630 of the sixth cooling apparatus 600 have the same shape and structure as the heat dissipation part 220 and the cooling fan 230 of FIG. 6.

The cooling rod 610 is formed in a circular rod shape, and a Peltier element 611 is attached to a lower surface thereof.

In addition, adhesive elements 612 to which carbon allotropes D are attached to adhesive surfaces and fixing bands 613 surrounding the adhesive elements 612 are installed on an outer circumferential surface of the cooling rod 610.

The adhesive elements 612 are formed in a band shape having an adhesive surface formed on one surface thereof so as to be attached to the outer circumferential surface of the cooling rod 610 in a ring shape, wherein a plurality of adhesive elements 612 are attached at intervals in the vertical direction.

Furthermore, when the adhesive elements 612 are attached, the adhesive elements 612 are attached to the outer circumferential surface of the cooling rod 610 while the carbon allotropes D are attached to the adhesive surfaces, so that the carbon allotropes D and the outer circumferential surface of the cooling rod 610 come into close contact to each other. Therefore, the cooling rod 610 comes into close contact with carbon allotropes D having high thermal conductivity, and cooling efficiency is increased.

The fixing bands 613 are formed in the shape of a plastic band and are installed to surround the adhesive elements 612 attached to the outer circumferential surface of the cooling rod 610.

When the adhesive elements 612 are used for a long time and adhesive force thereof is reduced, the fixing bands 613 prevent the adhesive elements 612 from being separated from the cooling rod 610.

In addition, a plurality of auxiliary cooling solution insertion grooves 614 are formed on an upper surface of the cooling rod 610.

A plurality of such auxiliary cooling solution insertion grooves 614 are formed on the upper surface of the cooling rod 610 at intervals.

Furthermore, the inside of the auxiliary cooling solution insertion grooves 614 are filled with cotton and a solution in which salt is dissolved in acetic acid.

The cotton is inserted into the auxiliary cooling solution insertion grooves 614 as absorbing the solution in which salt is dissolved in acetic acid.

Herein, the solution in which salt is dissolved in acetic acid has high thermal conductivity, and thus cooling efficiency of the cooling rod 610 increases.

In addition, since the solution in which salt is dissolved in acetic acid is absorbed by cotton, a storage period of the solution is increased compared when it exists in a liquid phase.

The sixth cooling apparatus 600 described as above has the same structure as the second cooling apparatus 200, but the fixing bands 613 are additionally installed to cover the adhesive elements 612 attached to the outer circumferential surface of the cooling rod 610 so that the adhesive elements 612 attached to the cooling rod 610 can be prevented from being separated from the cooling rod 610.

In addition, the sixth cooling apparatus 600 is configured such that cottons absorbing the solution in which salt is dissolved in acetic acid are inserted into the auxiliary cooling solution insertion grooves 614 formed on the cooling rod 610, respectively. Therefore, the cooling rod 610 exhibits cooling efficiency increased by the cottons absorbing the solution in which salt is dissolved in acetic acid.

What is claimed is:

1. A cooling apparatus comprising a case, a storage receptacle installed inside the case and storing water therein, and a cooling part for cooling the water stored in the storage receptacle, wherein the cooling part includes:

a cooling rod, an upper end portion of which penetrates a bottom surface of the storage receptacle and protrudes into the storage receptacle, and a lower end portion of which is positioned lower than the bottom surface of the storage receptacle;

a cooling means installed on a lower surface of the cooling rod so as to cool the cooling rod; and a tube body formed in a tube shape with an upper portion closed and installed to surround the cooling rod, wherein the tube body is composed of a double wall body with an inner wall and an outer wall, wherein the tube body includes a first partition plate and a second partition plate, the first and second partition plates spaced apart from each other in the vertical direction inside the tube body, wherein the tube body has a plurality of through holes formed in the inner wall, the outer wall, and the first and second partition plates, so as to allow water to flow into or out of the tube body.

2. The cooling apparatus according to claim 1, wherein the storage receptacle includes partition walls formed to be spaced from each other such that an inner space of the storage receptacle is separated by the partition walls, the partition walls each having a plate shape and containing at least one or more drain holes.

3. The cooling apparatus according to claim 1, wherein the cooling means is a thermoelectric element.

* * * * *